US009059507B2

(12) United States Patent
Schneider et al.

(10) Patent No.: US 9,059,507 B2
(45) Date of Patent: Jun. 16, 2015

(54) ANTENNA ASSEMBLIES INCLUDING ANTENNA ELEMENTS WITH DIELECTRIC FOR FORMING CLOSED BOW TIE SHAPES

(71) Applicant: Antennas Direct, Inc., Ellisville, MO (US)

(72) Inventors: Richard E. Schneider, Wildwood, MO (US); John Edwin Ross, III, Moab, UT (US); Corey Feit, St. Louis, MO (US)

( * ) Notice: Subject to any disclaimer, the term of this patent is extended or adjusted under 35 U.S.C. 154(b) by 0 days.

(21) Appl. No.: 14/563,449

(22) Filed: Dec. 8, 2014

(65) Prior Publication Data

US 2015/0091772 A1 Apr. 2, 2015

Related U.S. Application Data

(63) Continuation-in-part of application No. 14/215,675, filed on Mar. 17, 2014, which is a continuation of application No. 13/358,047, filed on Jan. 25, 2012, now Pat. No. 8,674,897.

(60) Provisional application No. 61/555,629, filed on Nov. 4, 2011.

(51) Int. Cl.

| | |
|---|---|
| ***H01Q 9/28*** | (2006.01) |
| ***H01Q 1/12*** | (2006.01) |
| ***H01Q 19/17*** | (2006.01) |
| ***H01Q 19/18*** | (2006.01) |
| ***H01Q 21/08*** | (2006.01) |

(52) U.S. Cl.

CPC ..... *H01Q 9/28* (2013.01); *H01Q 1/1221* (2013.01); *H01Q 1/1228* (2013.01); *H01Q 1/125* (2013.01); *H01Q 19/175* (2013.01); *H01Q 19/18* (2013.01); *H01Q 21/08* (2013.01)

(58) Field of Classification Search

CPC .. H01Q 19/28; H01Q 21/0006; H01Q 19/108

See application file for complete search history.

(56) References Cited

U.S. PATENT DOCUMENTS 2,615,005 A 10/1952 White
2,666,138 A 1/1954 Ehrbar et al.

(Continued)

OTHER PUBLICATIONS

UHF Outline Bow-Tie antenna; http://www.radioshack.com/product/index.jsp?productId=2062017&CAWELAID=107590; accessed Oct. 4, 2011; 6 pages.

(Continued)

*Primary Examiner* — Trinh Dinh

(74) *Attorney, Agent, or Firm* — Harness, Dickey & Pierce, P.L.C.

(57) ABSTRACT

An antenna assembly generally includes dielectric mounting members coupling at least one pair of bow tie antennas to an antenna support. A reflector is coupled to the antenna support. One or more pairs of electrical conductors extend between a balun and the at least one pair of bow tie antennas. The one or more pairs of electrical conductors electrically connect the balun with the at least one pair of bow tie antennas. The one or more pairs of electrical conductors include portions that are bent inwards generally towards the at least one reflector to create an impedance transformer and an improved impedance match at a feed point of the balun. The dielectric mounting members include one or more recessed portions or slots configured for providing a stop for angled electrical conductor portions of the electrical conductors and for providing a stop for straight electrical conductor portions of the electrical conductors.

20 Claims, 37 Drawing Sheets

(56) References Cited

U.S. PATENT DOCUMENTS

| | | | | |
|---|---|---|---|---|
| 3,373,432 | A | 3/1968 | Breneman | |
| 5,945,962 | A * | 8/1999 | Harrington et al. | 343/792.5 |
| 5,969,687 | A | 10/1999 | Podger | |
| 6,046,704 | A * | 4/2000 | Lopez | 343/821 |
| 6,054,963 | A | 4/2000 | Muterspaugh | |
| 6,271,800 | B1 | 8/2001 | Nakamura et al. | |
| 6,480,168 | B1 | 11/2002 | Lam et al. | |
| 7,990,332 | B1 | 8/2011 | Tischer | |
| 8,462,071 | B1 * | 6/2013 | Rudish et al. | 343/810 |
| 2007/0229379 | A1 * | 10/2007 | Eckwielen et al. | 343/757 |
| 2010/0302118 | A1 | 12/2010 | Suleiman et al. | |
| 2012/0075155 | A1 * | 3/2012 | Lindmark et al. | 343/797 |

OTHER PUBLICATIONS

DB8 Multidirectional HDTV Antenna; accessed Aug. 17, 2011; http://www.antennasdirect.com/store/DB8_HD_Antenna.html; 2 pages.

DB4 HDTV Mid Range UHF Antenna; http://www.antennasdirect.com/store/DB4_HDTV_antenna.html; accessed Aug. 17, 2011; 2 pages.

DB2 HDTV Antennas; http://www.antennasdirect.com/store/DB2_antenna.html; accessed Aug. 17, 2011.

* cited by examiner

ANTENNA ASSEMBLIES INCLUDING ANTENNA ELEMENTS WITH DIELECTRIC FOR FORMING CLOSED BOW TIE SHAPES

CROSS-REFERENCE TO RELATED APPLICATIONS

This application is a continuation-in-part of U.S. patent application Ser. No. 14/215,675 filed Mar. 17, 2014 (published as US2014/0198007 on Jul. 17, 2014), which, in turn, is a continuation of U.S. patent application Ser. No. 13/358,047 filed Jan. 25, 2012 (now U.S. Pat. No. 8,674,897 issued Mar. 18, 2014), which, in turn, claims the benefit of U.S. Provisional Application No. 61/555,629 filed Nov. 4, 2011. The entire disclosures of the above applications are incorporated herein by reference.

FIELD

The present disclosure generally relates to antenna assemblies configured for reception of television signals, such as high definition television (HDTV) signals.

BACKGROUND

The statements in this section merely provide background information related to the present disclosure and may not constitute prior art.

Many people enjoy watching television. Recently, the television-watching experience has been greatly improved due to high definition television (HDTV). A great number of people pay for HDTV through their existing cable or satellite TV service provider. In fact, many people are unaware that HDTV signals are commonly broadcast over the free public airwaves. This means that HDTV signals may be received for free with the appropriate antenna.

SUMMARY

According to various aspects, exemplary embodiments are provided of bow tie antennas and antenna assemblies that include the same. In an exemplary embodiment, a bow tie antenna includes a pair of antenna elements. Each antenna element includes spaced apart end portions defining an open portion such that the antenna element has an open shape. The open shape is closed by dielectric material disposed between the spaced apart end portions and extending across a gap separating the spaced apart end portions, whereby the dielectric material and pair of antenna elements cooperatively define a closed bow tie shape for the bow tie antenna.

Further aspects and features of the present disclosure will become apparent from the detailed description provided hereinafter. In addition, any one or more aspects of the present disclosure may be implemented individually or in any combination with any one or more of the other aspects of the present disclosure. It should be understood that the detailed description and specific examples, while indicating exemplary embodiments of the present disclosure, are intended for purposes of illustration only and are not intended to limit the scope of the present disclosure.

DRAWINGS

The drawings described herein are for illustration purposes only and are not intended to limit the scope of the present disclosure in any way.

Corresponding reference numerals indicate corresponding parts throughout the several views of the drawings.

DETAILED DESCRIPTION

Figure 1:
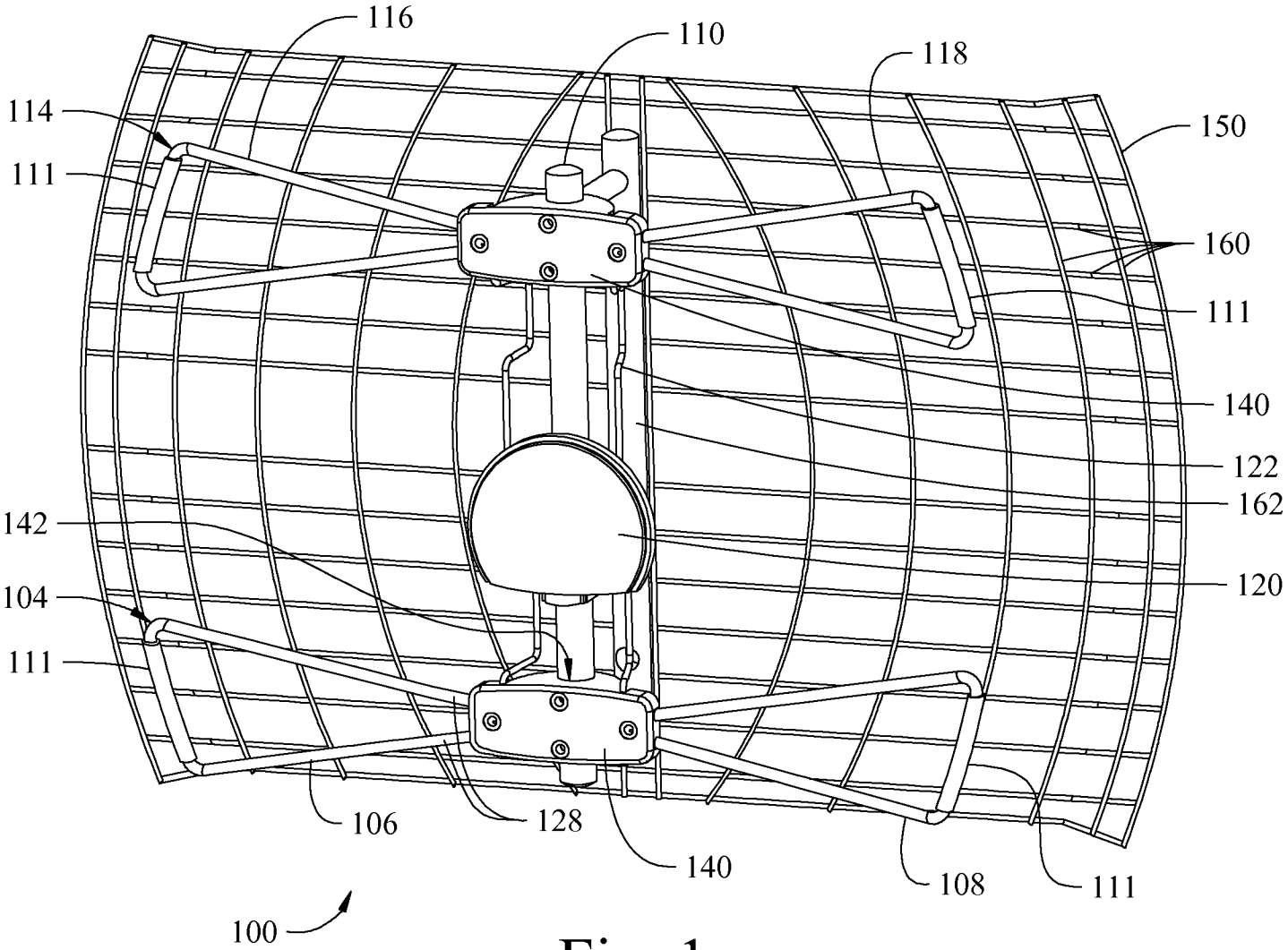
FIG. 1 is a perspective view of an antenna assembly including a pair of bow tie antennas and a reflector element according to an exemplary embodiment.

The following description is merely exemplary in nature and is in no way intended to limit the present disclosure, application, or uses.

According to various aspects, exemplary embodiments are provided of bow tie antennas and antenna assemblies that include bow tie antennas. In an exemplary embodiment, a bow tie antenna generally includes a pair of antenna elements. Each antenna element has spaced-apart portions defining an open portion or gap along the antenna element, such that the antenna element is not closed electrically. For closing the antenna elements' open shapes and forming closed shapes, dielectric material (e.g., dielectric tubing, etc.) is disposed generally between and/or is connected to the spaced-apart portions of each antenna element.

By having dielectric material extend across the open portion or gap of each antenna element, the open shape of each antenna element is thereby closed by dielectric material. Accordingly, the pair of antenna elements and dielectric material cooperatively define or provide a closed bow tie shape for the bow tie antenna.

In this exemplary embodiment, dielectric material is used to close the open shape of each antenna element. But each antenna element is not closed electrically by that dielectric material, which is electrically non-conductive and inoperable for galvanically connecting the spaced-apart portions of the antenna elements. In addition, the dielectric material may comprise pieces of tubing or other tubular, hollow members formed from various dielectric, non-conductive materials, such as plastic, rubber, composite materials, other dielectric materials, etc.

Advantageously, the dielectric material may also enhance the aesthetic appearance of the bow tie antenna or antenna assembly including the same. For example, the dielectric material may be a different color than the antenna elements such that the dielectric material adds color(s) (e.g., orange, red, etc.) to the bow tie antenna or antenna assembly including the same. Additionally, or alternatively, the dielectric material may also reduce the probably of eye injuries when the bow tie antenna is used indoors given that the dielectric material covers free end portions of the antenna elements, which might otherwise poke the inattentive passerby in the eye.

In another exemplary embodiment, an antenna assembly includes at least one bow tie antenna. At least one reflector is disposed relative to the at least one bow tie antenna for reflecting electromagnetic waves generally towards the at least one bow tie antenna.

In another exemplary embodiment, an antenna assembly generally includes an antenna support and at least one pair of spaced apart bow tie antennas. The bow tie antennas are coupled to the antenna support and symmetrically arranged in a generally coplanar manner. At least one reflector element is coupled to the antenna support and behind the at least one pair of bow tie antennas. The antenna assembly also includes a single balun. For example, in an antenna assembly that includes a single pair of bow tie antennas, a balun is at a point electrically equidistant from each bow tie antenna to ensure that the bow tie antennas are in phase. As another example, in an antenna assembly that includes two subarrays each including a pair of bow tie antennas, a balun is at a point electrically equidistant from each subarray such that the bow tie antennas are in phase.

In a further exemplary embodiment, an antenna assembly includes an antenna support having first and second pairs of spaced apart bow tie antennas coupled to an antenna support. The bow tie antennas of the first pair are symmetrically arranged in a generally coplanar manner on the antenna support. The bow tie antennas of the second pair are also symmetrically arranged in a generally coplanar manner on the antenna support. The second pair of bow tie antennas is offset from (e.g., below, above, side-by-side, etc.) relative to the first pair of bow tie antennas. A first reflector element is behind the first pair of bow tie antennas. A second reflector element is behind the second pair of bow tie antennas. The first and second reflector elements are coupled to the antenna support. Antenna mounting members may be used to mount the bow tie antennas to the antenna support. The antenna assembly also includes a single balun.

With reference to the figures, FIGS. 1 through 10 illustrate an exemplary embodiment of an antenna assembly 100 embodying one or more aspects of the present disclosure. As shown in FIG. 1, the antenna assembly 100 includes a pair of spaced apart bow tie antennas 104, 114. As disclosed herein, the bow tie antenna 104 includes a pair of antenna elements 106 and 108, and the bow tie antenna 114 includes a pair of antenna elements 116, 118.

Figure 11:
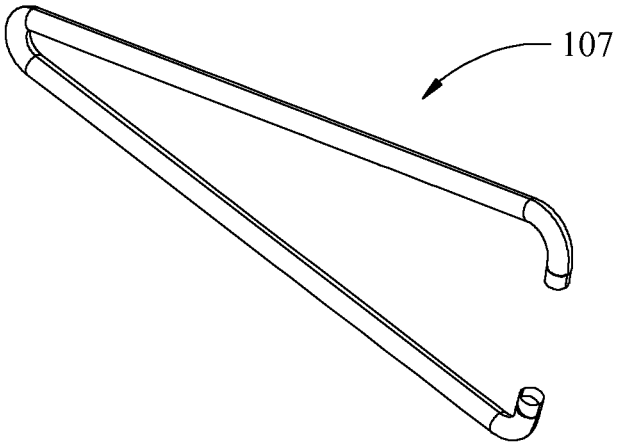
FIGS. 11 through 21 are views of various components that may be used in the antenna assembly shown in FIGS. 1 through 9 according to an exemplary embodiment.
Figure 12:
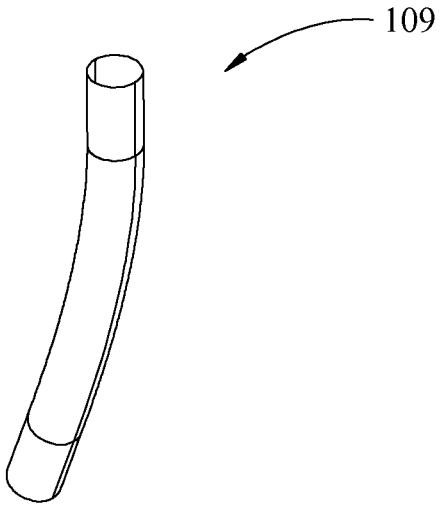

Each antenna element 106, 108, 116, 118 has spaced-apart portions defining an open portion or gap along the antenna element (e.g., antenna element 107 shown in FIG. 11, etc.), such that the antenna element is not closed electrically and has an open geometric shape. For closure, non-conductive or dielectric material 111 (e.g., dielectric tubing 107 shown in FIG. 12, etc.) is disposed generally between and/or is connected to the spaced-apart portions of each antenna element. By having dielectric material extend across the open portion or gap of each antenna element, the open shape of each antenna element is thereby closed by dielectric material. Accordingly, the pair of antenna elements 106, 108 and dielectric material 111 cooperatively define or provide a closed shape for the bow tie antenna 104. Similarly, the pair of antenna elements 116, 118 and dielectric material 111 cooperatively define or provide a closed shape for the bow tie antenna 114.

Each antenna element 106, 108, 116, 118, however, is not closed electrically by the dielectric material 111, which is electrically non-conductive and inoperable for galvanically connecting the spaced-apart portions of the antenna elements 106, 108, 116, 118. The dielectric material 111 may comprise pieces of tubing or other tubular, hollow members formed from various dielectric or non-conductive materials, such as plastic, rubber, composite materials, other dielectric materials, etc.

Figure 16A:
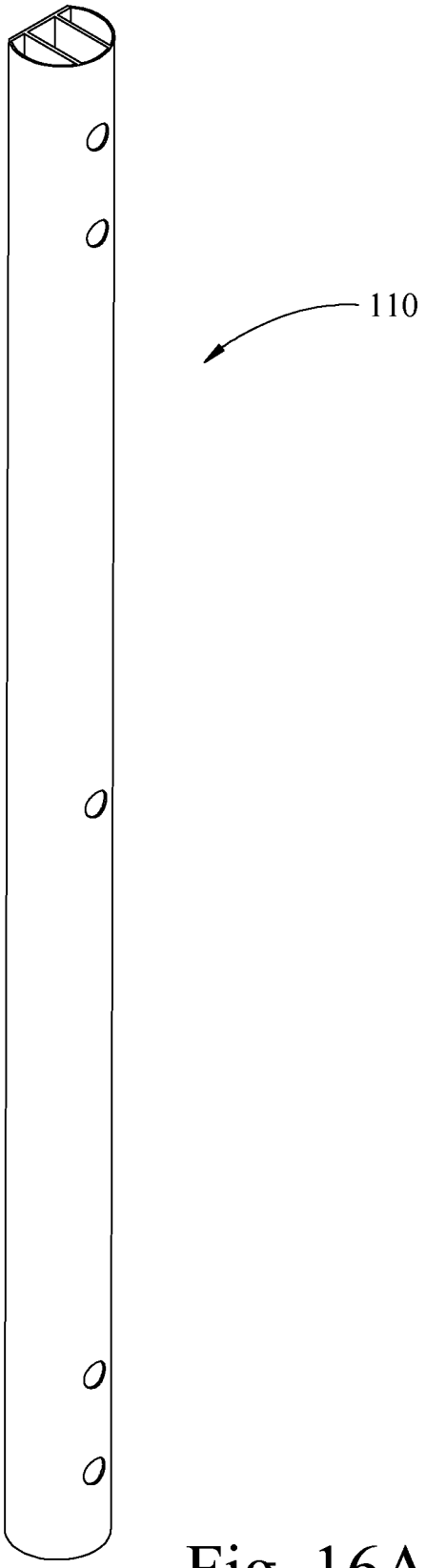
Figure 16B:
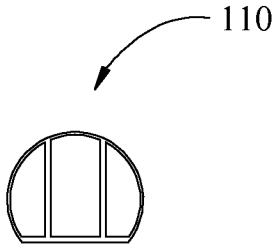

The bow tie antennas 104, 114 are symmetrically arranged in a generally coplanar manner on an antenna support 110. By way of example only, FIGS. 16A and 16B illustrate an example antenna support 110 to which the bow tie antennas 104, 114 may be mounted. As shown in FIGS. 16A and 16B, the illustrated antenna support 110 has a D-shaped cross section with interior ribs or strengthening members, although other configurations may also be used (e.g., circular cross section, rectangular cross section, etc.). The antenna support 110 may be formed from a wide range of materials, such as aluminum, other electrically conductive metal, etc.

The antenna assembly 100 further includes a transformer (e.g., a printed circuit board (PCB) balun, etc.) concealed under and/or housed within the housing 120. Antenna mounting members 140 are used to couple (e.g., mount, attach, etc.) the bow tie antennas 104, 114 to the antenna support 110. A reflector element 150 is coupled to the antenna support 110, such that the reflector 150 is offset from and behind the bow tie antennas 104, 114.

The first bow tie antenna 104 includes a pair of generally elongated triangular or trapezoidal shaped antenna elements 106 and 108. The pair of triangular or trapezoidal shaped antenna elements 106, 108 are arranged to cooperatively define or provide a generally bow tie shape for the antenna 104. Similarly, the second bow tie antenna 114 includes a pair of generally elongated triangular or trapezoidal shaped antenna elements 116, 118 that are arranged to cooperatively define or provide a generally bow tie shape for the antenna 114.

The antenna elements 106, 108, 116, 118 may be formed from various materials, such as electrically-conductive wires, rods, hollow tubing, or other suitable electrical conductor formed to have an outer periphery or perimeter defining the triangular or trapezoidal shaped antenna elements 106, 108, 116, 118. The antenna elements 106, 108 116, 118 may each form a triangle having an open end or open portion which will be towards the outside of the bow tie shape when assembled, and having a closed end or closed portion which will be towards a middle or center of the bow tie shape when assembled. The spaced apart end portions of each antenna element may be connected (e.g., by a piece of dielectric tubing, dielectric tubular or hollow member, etc.).

A wide range of materials and manufacturing processes may be used for the bow tie antennas 104, 114. By way of example only, the bow tie antennas 104, 114 and/or triangular or trapezoidal shaped antenna elements thereof may be formed from an electrically conductive material, such as aluminum, copper, stainless steel, other metals, alloys, etc. In another embodiment, the bow tie antennas 104, 114 and/or triangular or trapezoidal shaped antenna elements thereof may be stamped from sheet metal. In an example embodiment, each bow tie antenna 104, 114 has a width of about 448 millimeters on the wider portion and about 421 millimeters on narrower portion (center to center), a gap of about 62 millimeters between the spaced apart ends, and a thickness or depth of about 5 millimeters which thickness corresponds to the thickness of the conductor from which the antenna elements are formed.

Figure 14A:
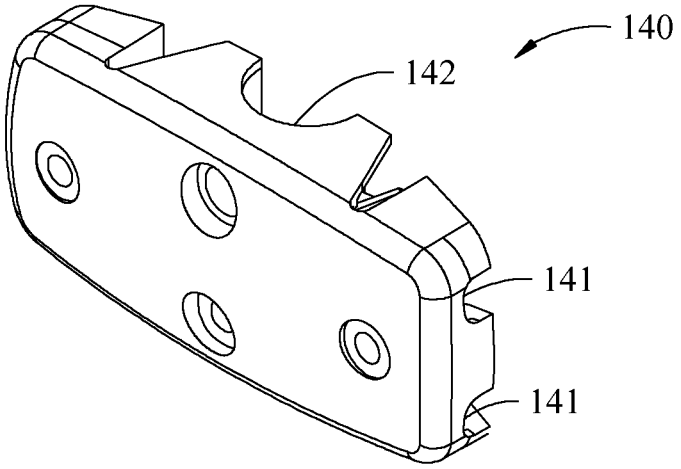
Figure 14B:
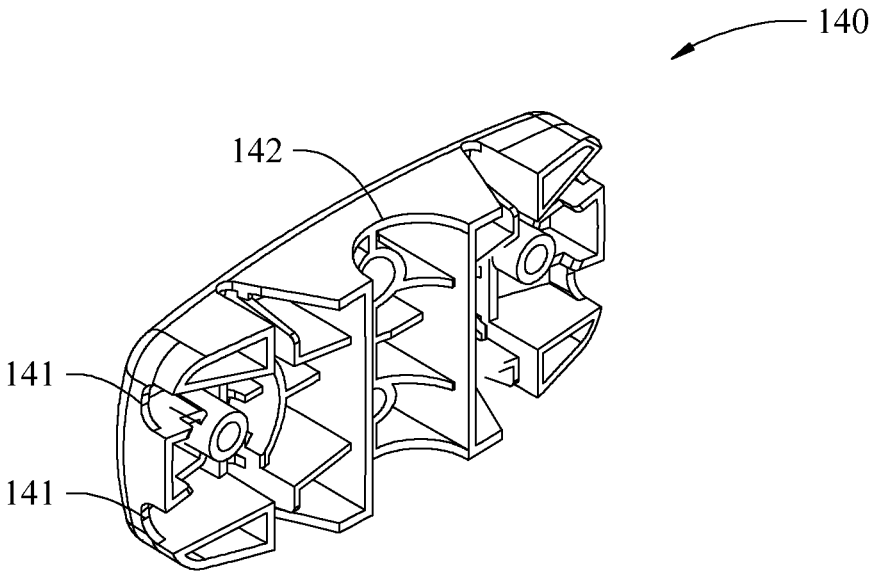

As shown in FIGS. 1 through 10, each bow tie antenna 104, 114 is substantially planar with a generally constant or substantially uniform thickness. The bow tie antennas 104, 114 are mounted to the antenna support 110 by antenna mounting members 140. By way of example, FIGS. 14A and 14B are respective front and back views of an exemplary antenna mounting member 140 that may be used to couple the bow tie antennas 104, 114 to the antenna support 110.

The antenna mounting members 140 (e.g., brackets, mounts, etc.) are preferably made of a non-conductive, dielectric material (e.g., plastic, etc.), such that the bow tie antennas 104, 114 may be electrically insulated from the antenna support 110. The antenna mounting members 140 may include slots or apertures 141 (FIGS. 14A and 14B) for receiving end portions of the antenna elements 106, 108, 116, 118. Each antenna mounting member 140 includes a recessed or slotted portion 142 configured to mount against the antenna support 110, and may be secured to the antenna support 110 via one or more mechanical fasteners (e.g., screws, rivets, etc.) or other suitable attachment means. In addition, the antenna mounting members or supports 140 are also configured (e.g., with recessed portions or slots, etc.) for providing a stop for angled end portions of transmission lines (e.g., transmission lines 122 in FIG. 1, etc.) and for providing a stop for straight end portions of transmission lines (e.g., straight transmission lines shown in FIG. 27, etc.). Alternative embodiments may include other means for mounting the bow tie antennas 104, 114 to the antenna support 110.

The reflector element 150 is also coupled to the support 110. The reflector element 150 includes a generally flat or planar mesh or grill surface. The reflector element 150 may be generally operable for reflecting electromagnetic waves generally towards the antennas 104, 114.

In regard to the size of the reflector 150 and spacing relative to the bow tie antennas 104, 114, the inventors hereof have recognized that the size of the reflector element 150 and spacing relative to the antennas 104, 114 strongly impact performance. Placing the bow tie antennas 104, 114 too close to the reflector element 150 provides an antenna with good gain, but may result in a narrow impedance bandwidth and poor voltage standing wave ratio (VSWR). If the bow tie antennas 104, 114 are placed too far away from the reflector element 150, the gain may be reduced due to improper phasing. When the size and proportions of the bow tie antennas 104, 114, the reflector size, and spacing between the reflector element 150 and bow tie antennas 104, 114 are properly chosen, there is an optimum or improved configuration that takes advantage of the near zone coupling with the reflector element to produce enhanced impedance bandwidth, while mitigating the effects of phase cancellation. The net result is an exemplary balance between impedance bandwidth, directivity or gain, radiation efficiency, and physical size. In this example, the reflector element 150 is offset by a distance of about 124 millimeters from the bow tie antennas 104, 114, to separate the reflector's planar surface from the surface of the antennas 104, 114. The dimensions in this paragraph (as are all dimensions disclosed herein) are provided for illustrative purposes only.

In this illustrated embodiment, the reflector element 150 is generally rectangular in shape. The reflector element 150 includes a grill or wire mesh surface 160. In addition, the reflector 150 may include a reflector support 162 disposed on, along, or adjacent to the mesh surface 160, to provide reinforcement to the mesh surface 160 and/or a means for supporting or coupling the reflector element 150 to the antenna support 110. The reflector 150 may also be curved to improve aesthetic appearance and/or reduce the risk of accidental injury when used indoors.

Figure 17A:
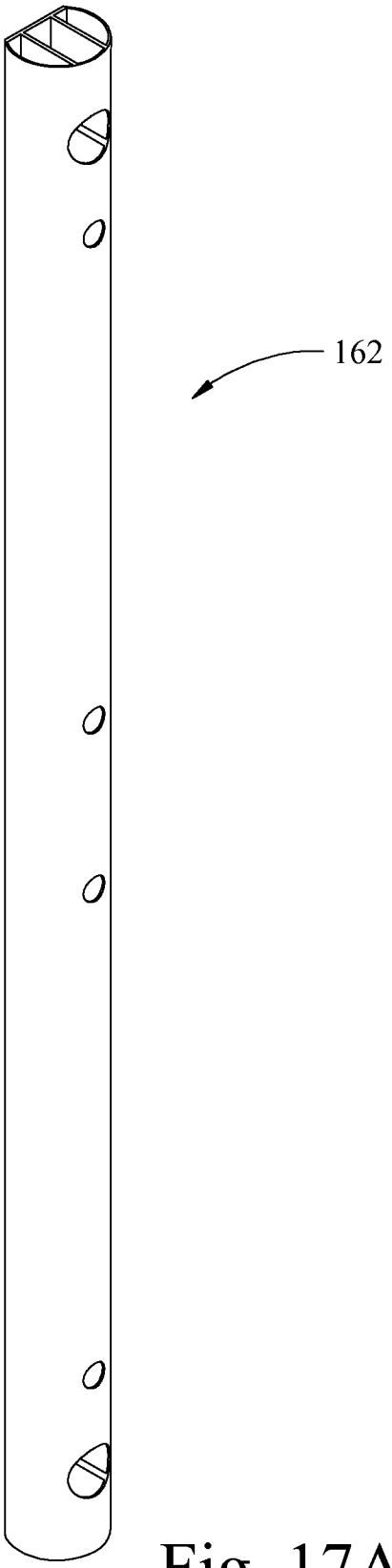
Figure 17B:
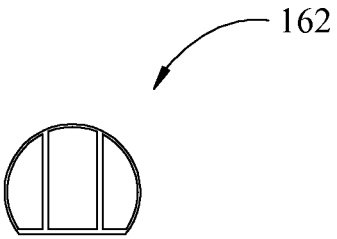

By way of example only, FIGS. 17A and 17B illustrate an example reflector support 162. As shown in FIGS. 17A and 17B, the illustrated reflector support 162 has a D-shaped cross section with interior ribs or strengthening members, although other configurations may also be used (e.g., circular cross section, rectangular cross section, etc.). The reflector support 162 may be formed from a wide range of materials, such as aluminum, other electrically conductive metal, etc.

Also by way of example only, the reflector element 150 may be configured to have a width (from left to right in FIG. 1) of about 23 inches, a height (from top to bottom in FIG. 1) of about 16.25 inches, and be offset from the bow tie antennas 104, 114 such that the antenna assembly 100 has an overall depth of about 7 inches from the front surface of the bow tie antennas 104, 114 to the back of the reflector's mesh surface 160.

A wide range of materials may be used for the reflector element 150. In an exemplary embodiment, the reflector element 150 includes powder coated steel. Alternative embodiments may include a differently configured reflector (e.g., different material, etc.), such as a reflector made of stainless steel, aluminum, or anti-corrosion treated copper. Spaces or notches may also be provided in the reflector element 150 to facilitate mounting of the reflector element 150 or antenna assembly 100. Alternative embodiments may have reflectors without such spaces or notches.

Figure 13A:
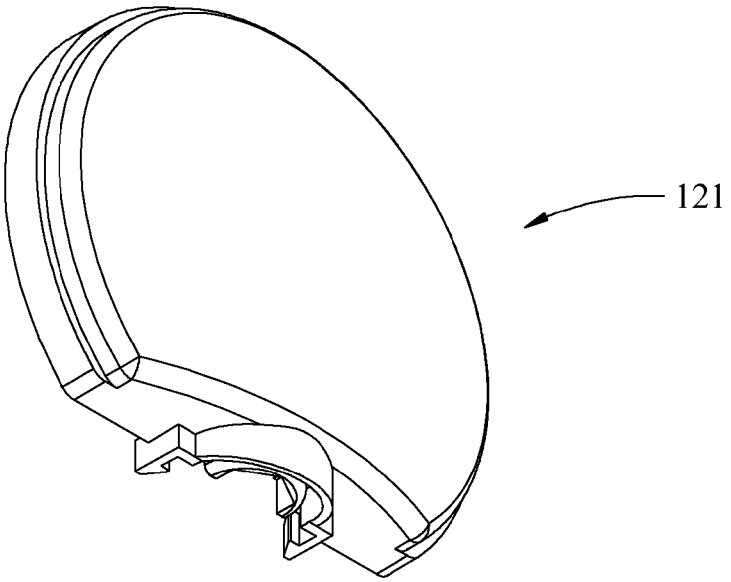
Figure 13B:
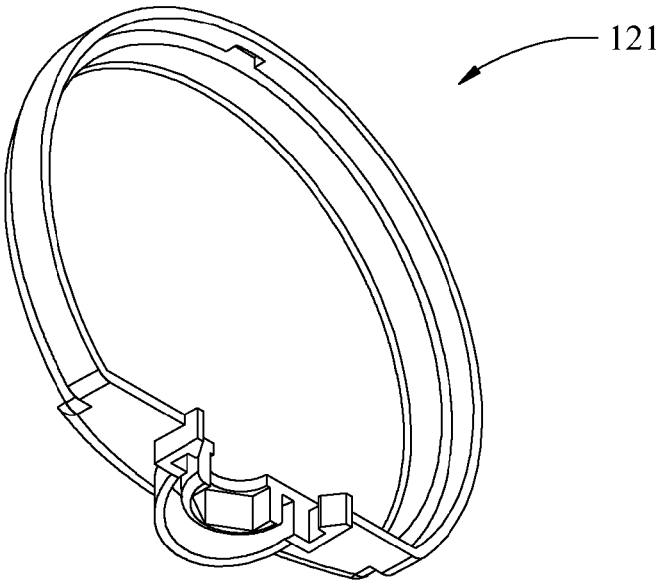
Figure 13C:
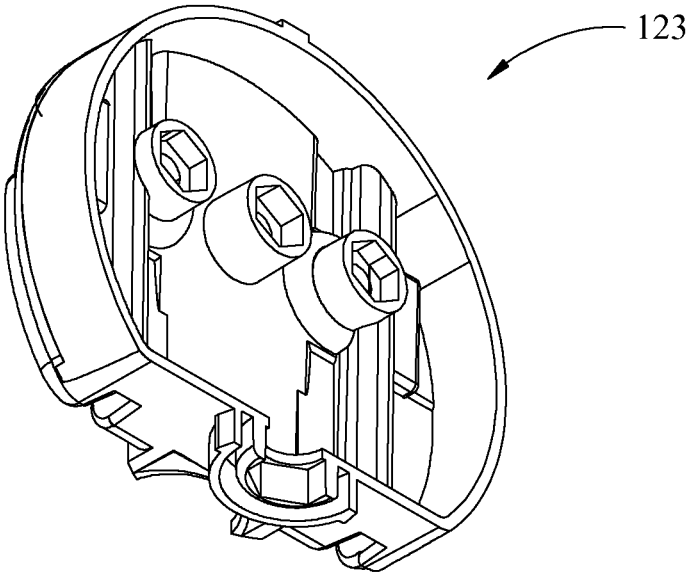
Figure 13D:
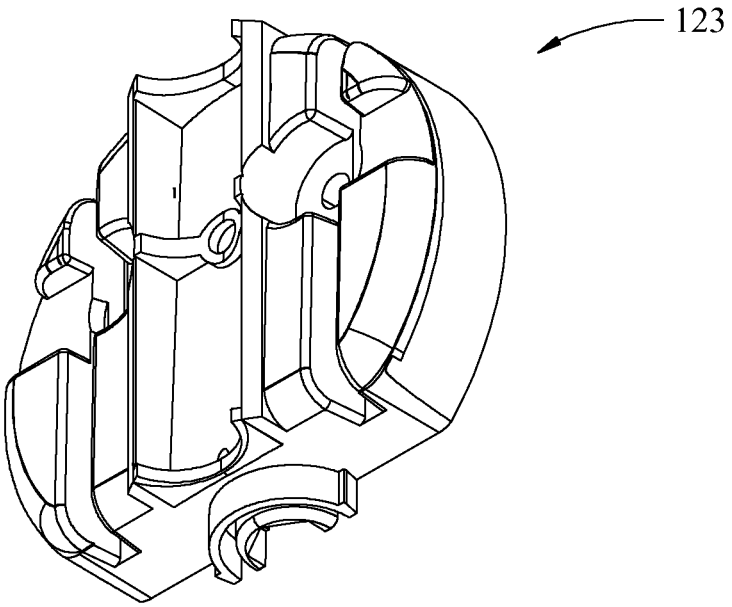

The antenna assembly 100 further includes a balun concealed under and/or housed within the housing portion 120. By way of example only, FIGS. 13A and 13B are respective front and back view of a first housing portion 121 that may be coupled to the second housing portion 123 shown in FIGS. 13C and 13D to provide a housing 120 in which a transformer may be housed such that the antenna assembly 100 includes an all-weather balun.

In an exemplary embodiment, the antenna assembly 100 includes a printed circuit board having the balun, which is operable for converting a balanced line into an unbalanced line. The balun may be coupled to the antenna support 110 between the spaced apart pair of bow tie antennas 104, 114, such that the balun is at a point electrically equidistant from each bow tie antenna 104, 114 to ensure that the bow tie antennas 104, 114 are in phase. The balun may be electrically connected to the bow tie antennas 104, 114 via one or more pairs of wires or electrical conductors 122 that extend between the balun and the bow tie antennas 104, 114.

Figure 20:
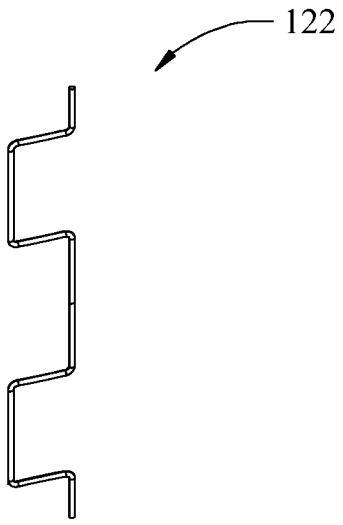

By way of example only, FIG. 20 illustrates an example electrical conductor 122 (e.g., bent or shaped wire, etc.) that be used in the antenna assembly 100. The axial spacing of the electrical conductors 122 forms a parallel wire transmission structure of a particular characteristic impedance. The wires 122 on the two bow tie antenna element array are bent inwards in such a way over part of their length so as to create an impedance transformer and effect an improved impedance match at the feed point (balun) of the antenna assembly 100. In the case of the four bow tie element array 200, a corporate feed is used. The wires connecting each two bow tie element sub array are straight while wires connecting to the balun are bent towards the reflector and then back toward the balun in a way that maintained constant characteristic impedance throughout the array. Moreover, the use of the corporate feed structure maintains phasing of all elements across frequencies both in and outside the passband of the antenna assembly. Conventional low cost four element bow tie arrays use a single feed line to connect all elements with a twist introduced in the line to maintain uniform phasing. But this twist method only achieves ideal phasing at or near the center of the passband. At frequencies below the passband, the twist introduces a phase shift which tends to cause a cancellation effect on each pair of elements. This dramatically reduces gain for VHF television channels. The corporate feed used in embodiments of the inventors' antenna assemblies tends to maintain uniform phasing across a wider range of frequencies and enhance performance when receiving VHF signals.

Figure 27:
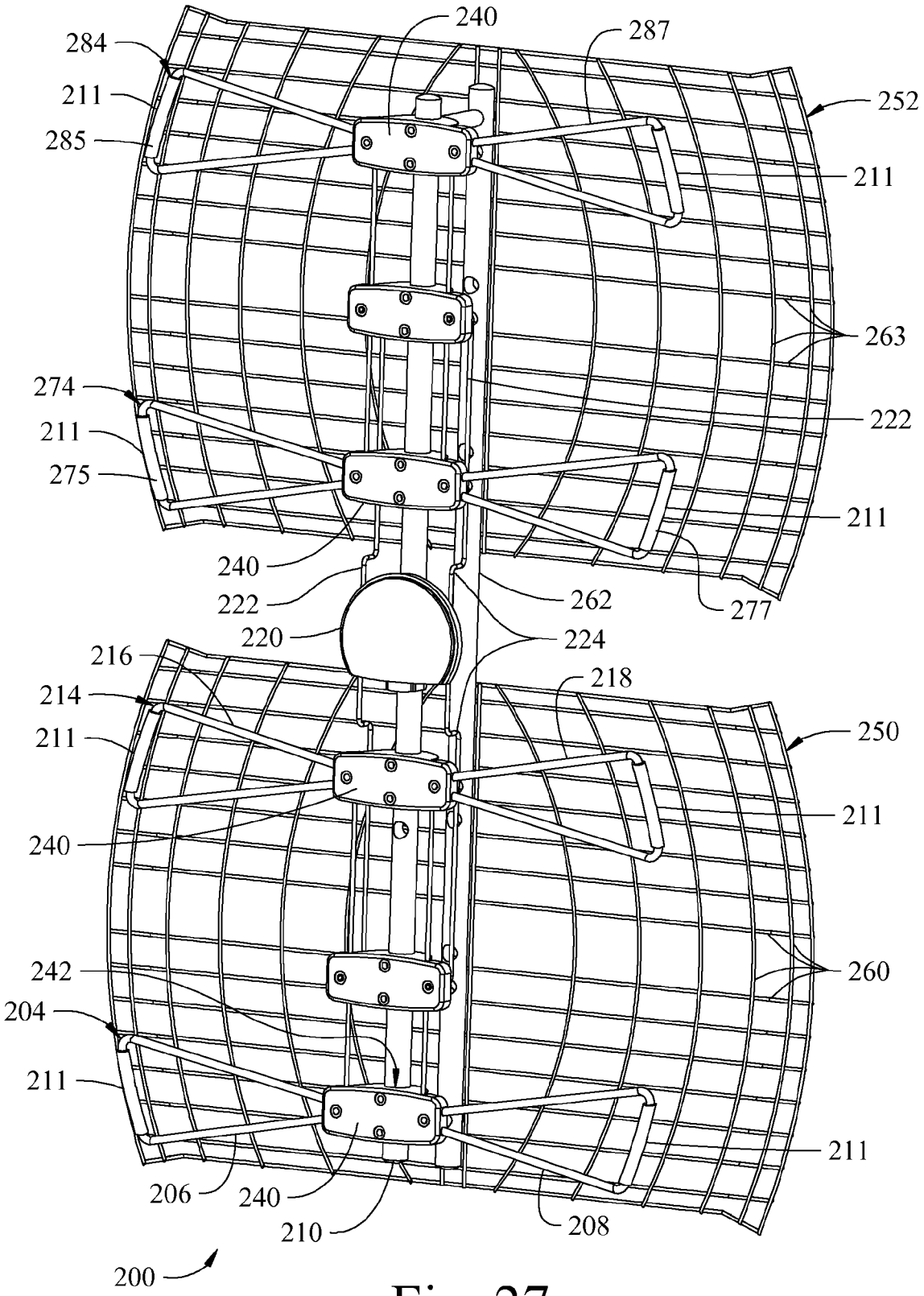
FIG. 27 is a perspective view of another exemplary embodiment of an antenna assembly including two pairs of bow tie antennas and a reflector element.

The antenna mounting members, supports, or pieces used to mount the bow tie antenna elements may also be configured in such a way to provide proper support for both a two element configuration (e.g., antenna assembly 100 etc.) with narrow spacing as well as the four element configuration (e.g., antenna assembly 200, etc.) with uniform wide spacing. The antenna mounting members, supports, or pieces (e.g., antenna mounting members 140, 240, etc.) may also be configured in such a way to provide proper support for both a two element configuration (e.g., antenna assembly 100 etc.) with narrow spacing as well as the four element configuration (e.g., antenna assembly 200, etc.) with uniform wide spacing. For example, and as shown in FIG. 1, the antenna mounting members 140 are configured for providing a stop for angled end portions of the transmission lines 122 in the two bow tie antenna element assembly or array 100. And as shown in the example of FIG. 27, the antenna mounting members 240 are also configured for providing a stop for straight end portions of transmission lines in the four bow tie antenna element assembly or array 200.

Alternative embodiments may include different means for connecting the balun to the bow tie antennas 104, 114. A balun using a PCB as a substrate with a ferrite core may also be used. The antenna assembly 100 may further include a connector (not shown) for connecting a coaxial cable 126 (FIGS. 2, 3, and 4) or other communication link or line to the antenna assembly 100.

Figure 2:
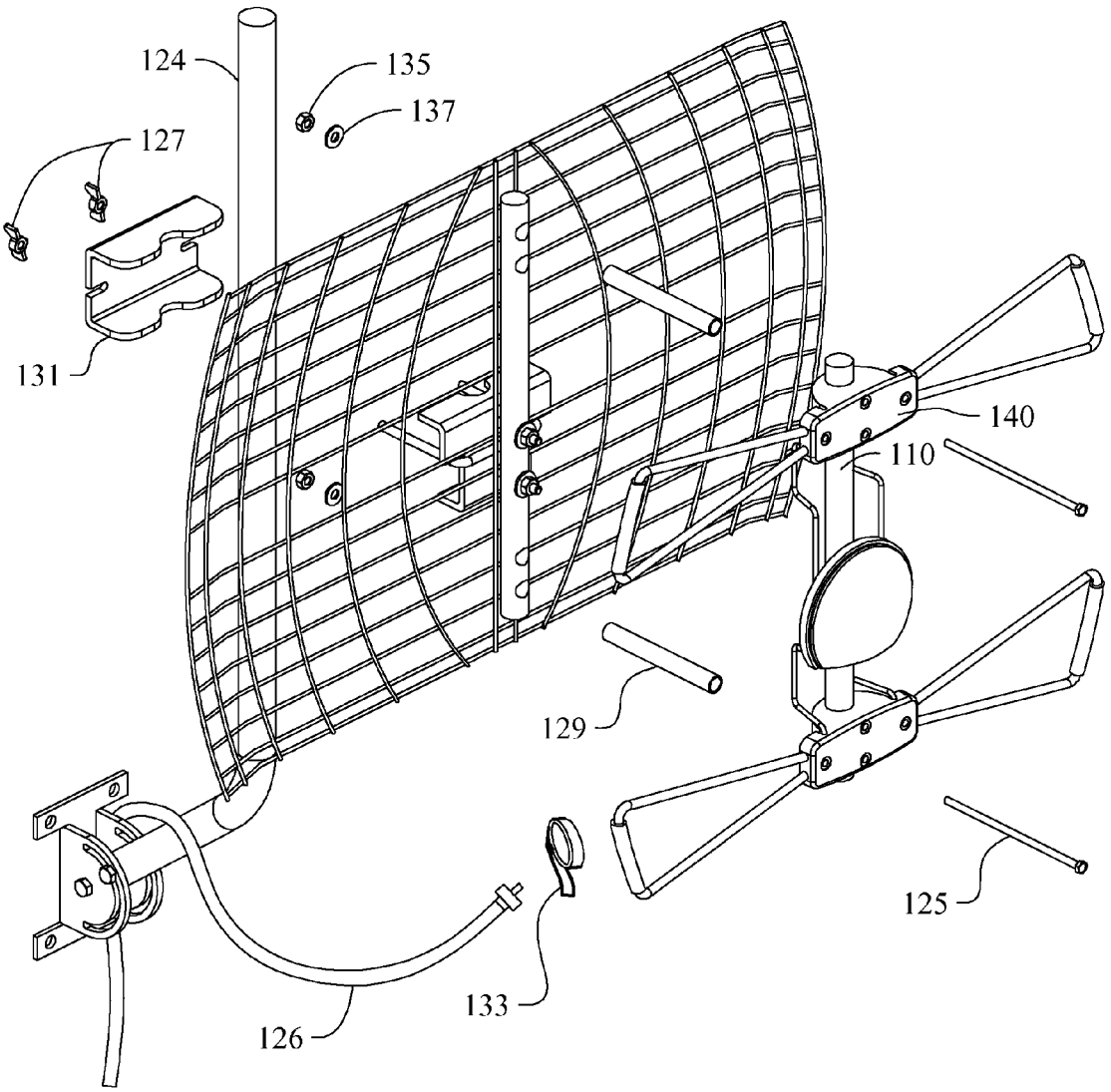
FIG. 2 is an exploded perspective of the antenna assembly shown in FIG. 1 and illustrating an exemplary manner by which the antenna assembly may be assembled and mounted to a mast according to an exemplary embodiment.
Figure 3:
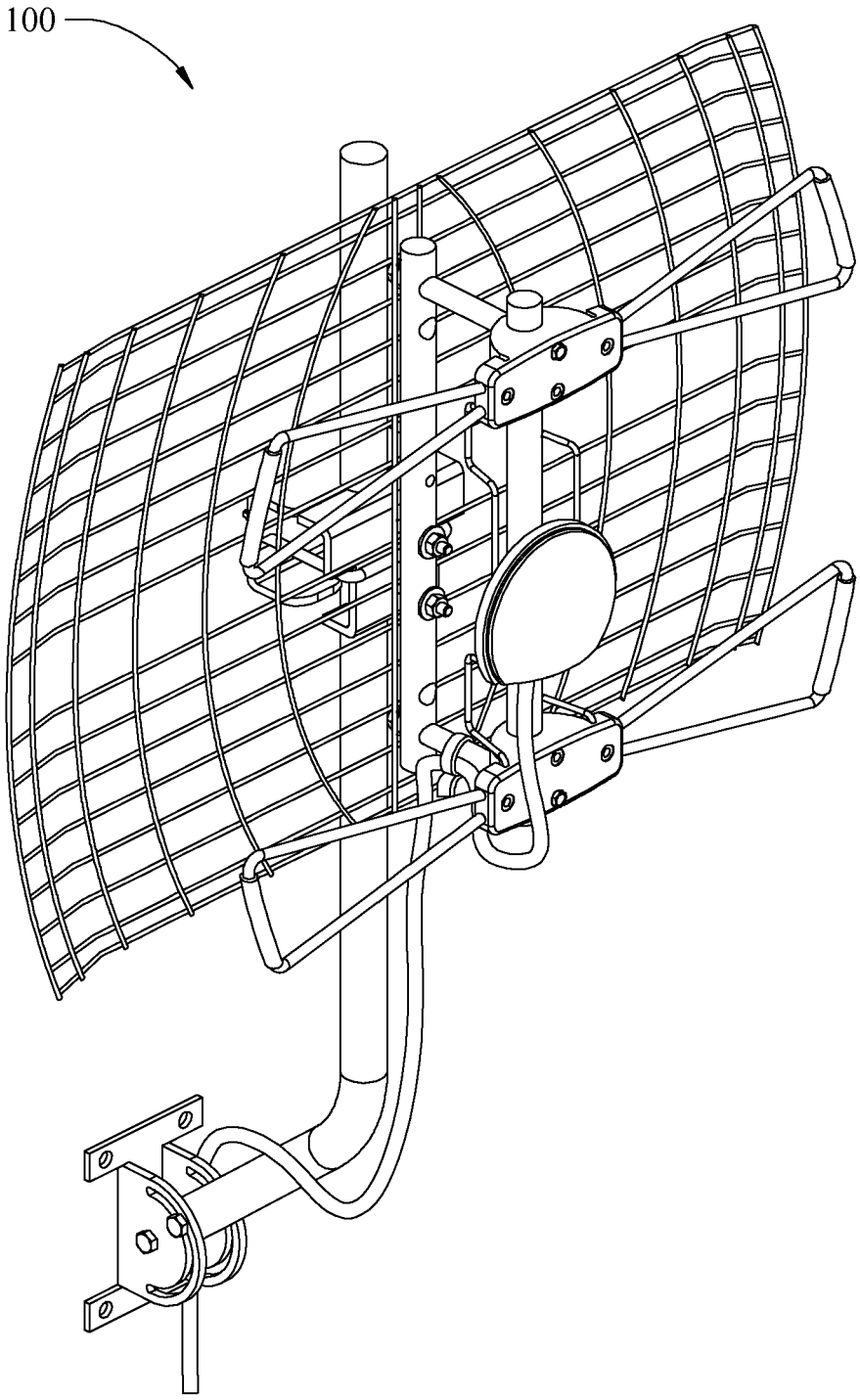
FIG. 3 is a perspective view illustrating the antenna assembly after being assembled and mounted to the mast.
Figure 15A:
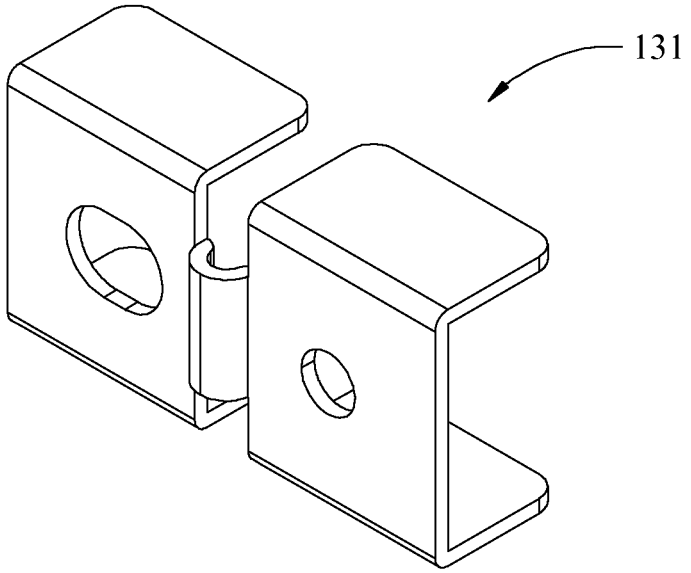
Figure 15B:
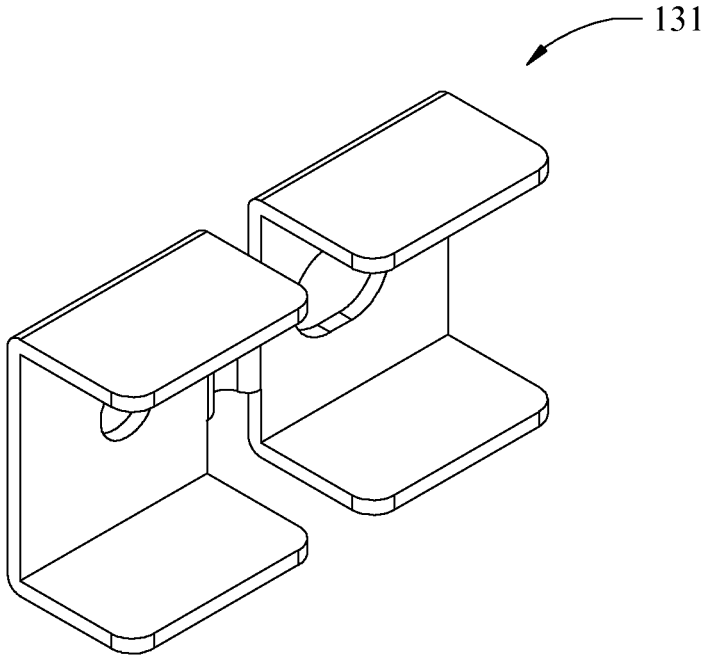

The antenna assembly 100 may be assembled and mounted to a mast 124 as shown in FIGS. 2 and 3. As shown in FIG. 2, this process includes the use of bolts 125, wing nuts 127, sleeves 129, mast clamps 131 (e.g., mast clamp 131 shown in FIGS. 15A and 15B, etc.), a zip tie 133, a nut 135, a washer 137, etc. But these fasteners for assembling and mounting the antenna assembly 100 are provided for purpose of illustration only as other embodiments may include different means and/or different processes for assembling and mounting an antenna assembly.

Figure 4:
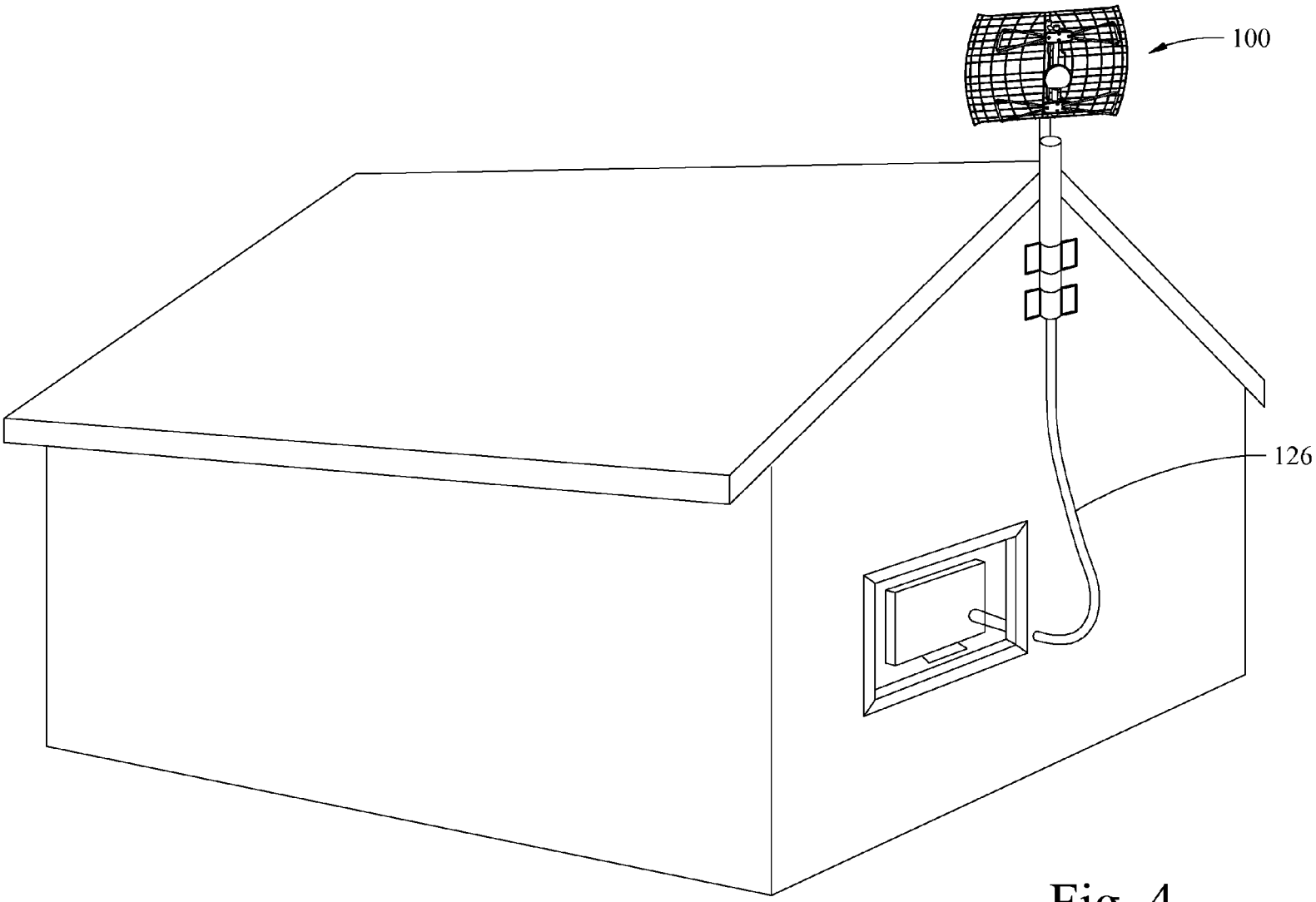
FIG. 4 is a perspective view illustrating an exemplary use for the antenna assembly shown in FIG. 1 with a coaxial cable connecting the antenna assembly to a television, whereby the antenna assembly is operable for receiving signals and communicating the same to the television via the coaxial cable.
Figure 5:
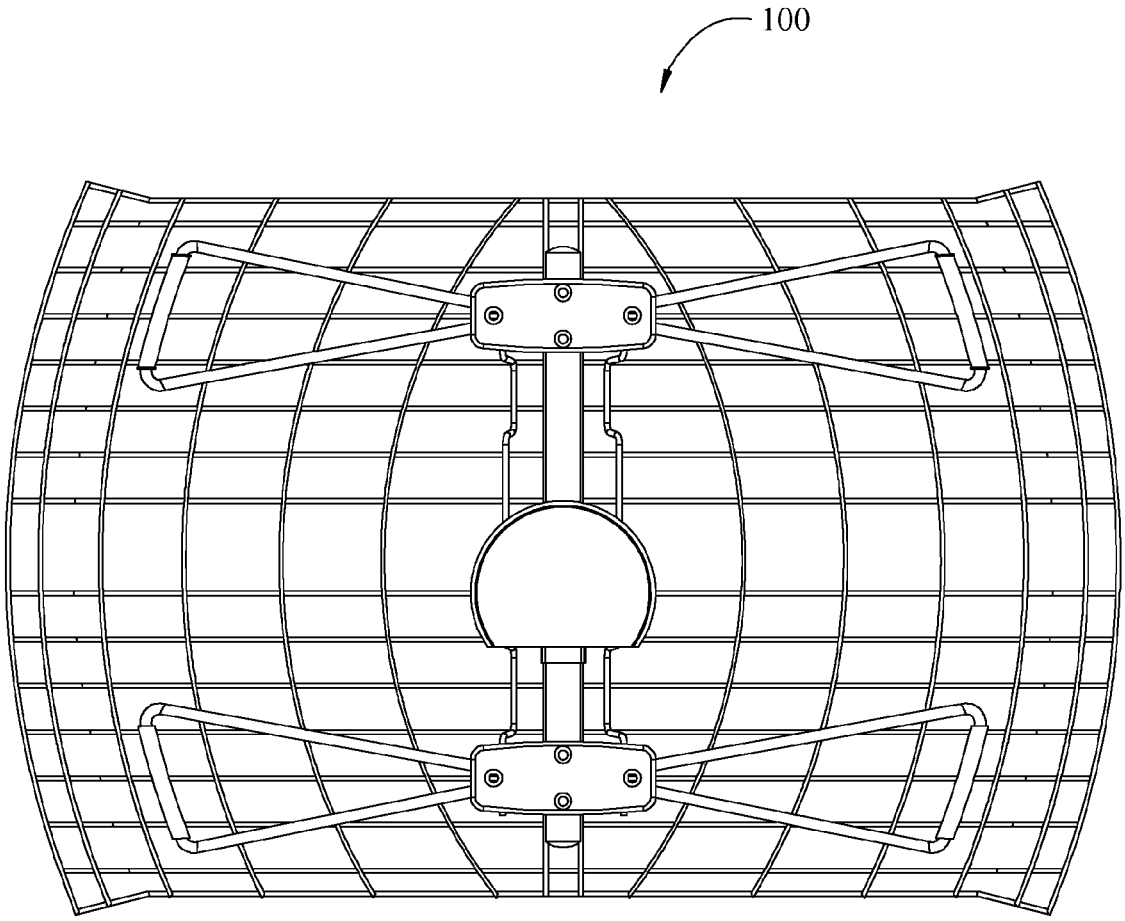
FIG. 5 is a front view of the antenna assembly shown in FIG. 1.
Figure 6:
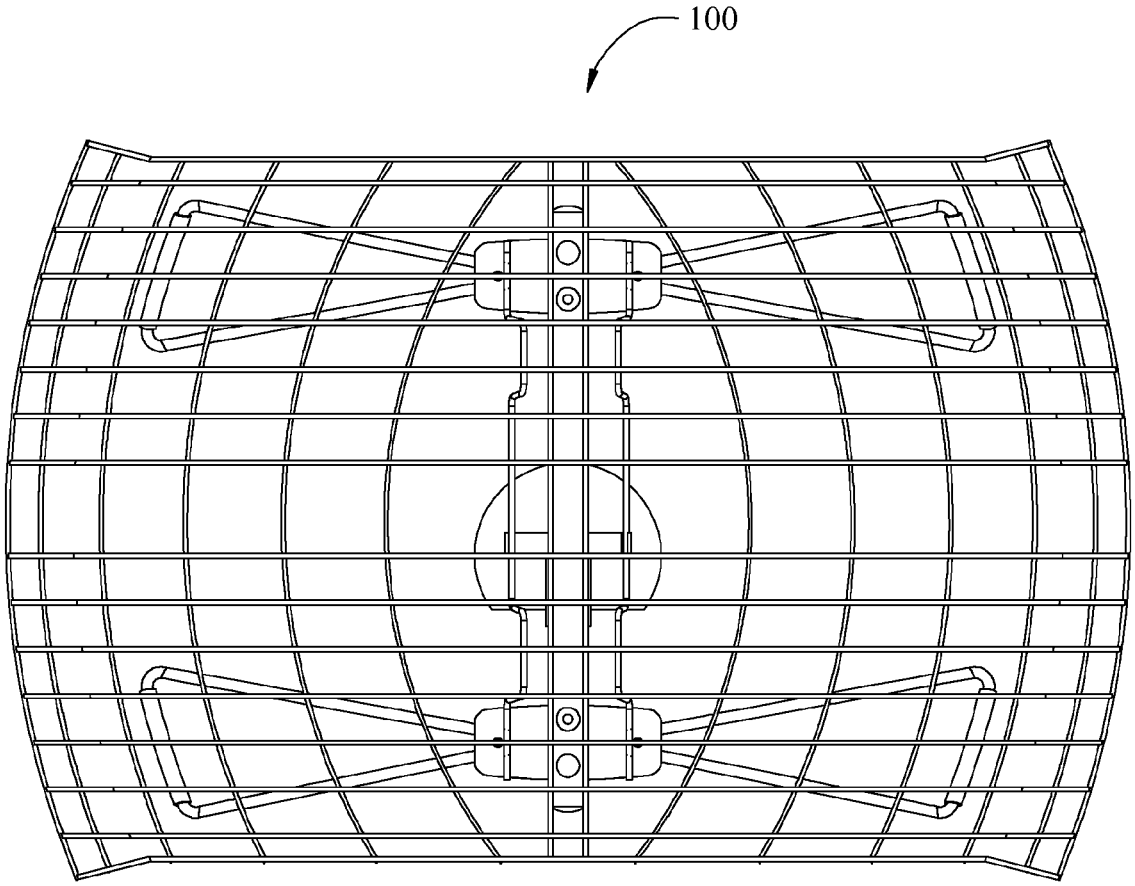
FIG. 6 is a back view of the antenna assembly shown in FIG. 1.
Figure 7:
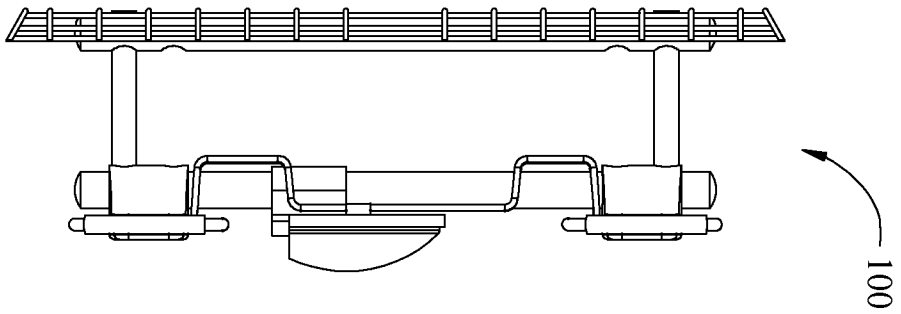
FIG. 7 is a left side view of the antenna assembly shown in FIG. 1.
Figure 8:
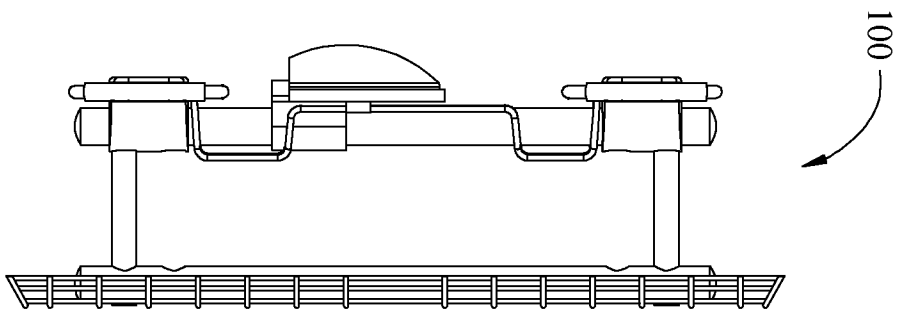
FIG. 8 is a right side view of the antenna assembly shown in FIG. 1.
Figure 9:
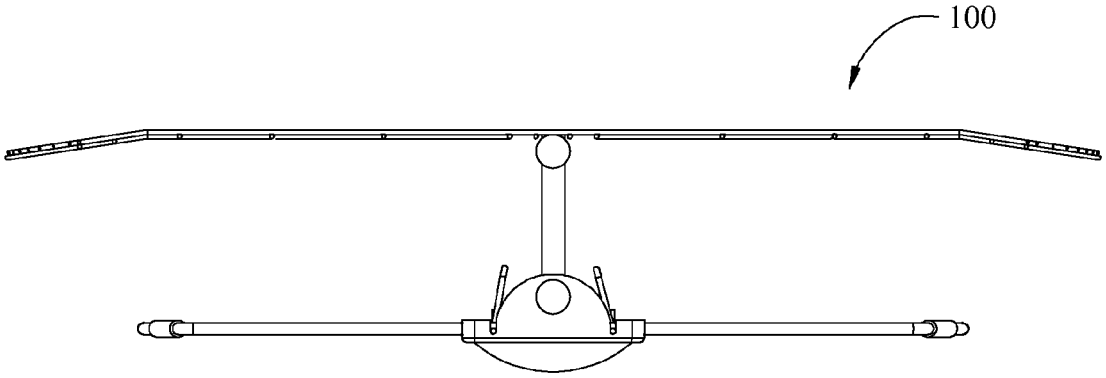
FIG. 9 is a top view of the antenna assembly shown in FIG. 1.
Figure 10:
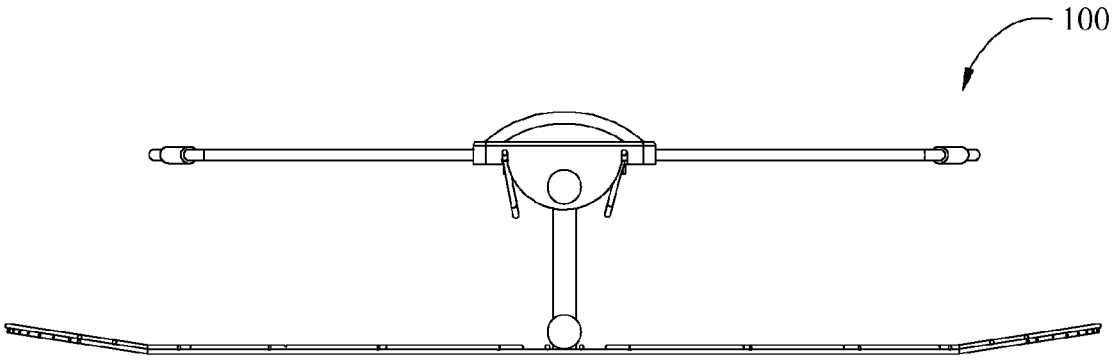
FIG. 10 is a bottom view of the antenna assembly shown in FIG. 1.

As shown in FIG. 4, the antenna assembly 100 may be used atop a house (e.g., mounted to or above a rooftop, etc.) for receiving digital television signals (of which high definition television (HDTV) signals are a subset) and communicating the received signals to an external device, such as a high definition flat screen television inside a home. In the illustrated embodiment, a coaxial cable 126 is used for transmitting signals received by the antenna assembly 100 to the television. Alternative embodiments may include an antenna assembly positioned inside or within an interior of a building or residence, inside an attic, etc. In one example, the antenna assembly 100 may include a 75-ohm RG6 coaxial cable 126 fitted with an F-Type connector.

FIGS. 22 through 26 illustrate performance data measured for a prototype of the antenna assembly 100 shown in FIG. 1. In FIGS. 22 through 25, the computer-simulated performance data was obtained using a state-of-the-art simulator with the following assumptions of a perfect electrical conductor (PEC), free space, PCB balun included, and 75 ohm reference. The data and results shown in FIGS. 22 through 26 are provided only for purposes of illustration and not for purposes of limitation. Accordingly, an antenna assembly may be configured to have operational parameters substantially as shown in any one or more of FIGS. 22 through 26, or it may be configured to have different operational parameters depending, for example, on the particular application and signals to be received by the antenna assembly.

Electrical data for the antenna assembly 100 included a design pass band for UHF 470 MHz to 698 MHz with channels 14-51, a nominal impedance of 75 ohms, and an F-Female connector. In addition, the performance data included computer-based front-to-back ratio of boresight gain to maximum gain in the rear hemisphere based on the azimuth and elevation cuts of about 13.46 dB at 470 MHz, about 15.52 dB at 546 MHz, about 17.5 dB at 622 MHz, and about 18.53 dB at 698 MHz.

Figure 22:
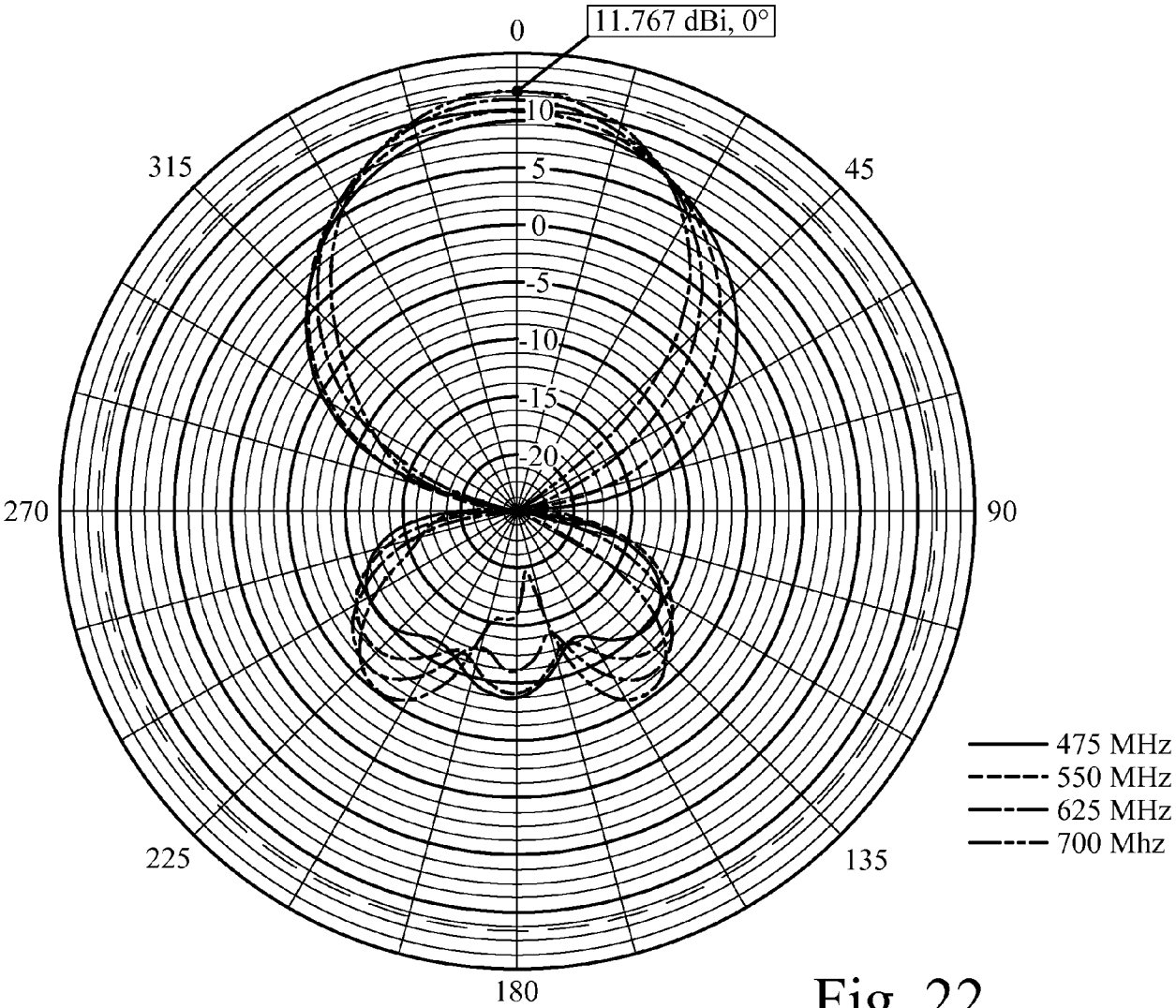
FIG. 22 is an exemplary line graph showing computer-simulated gain (in decibels referenced to isotropic gain (dBi)) versus azimuth angle at various frequencies (in megahertz (MHz)) for the antenna assembly shown in FIG. 1.

FIG. 22 is an exemplary line graph showing computer-simulated gain versus azimuth angle at various frequencies (in megahertz (MHz)) for the antenna assembly 100. The performance data included azimuth values (half power beam width) of about 55.5 degrees at 470 MHz, about 50.5 degrees at 546 MHz, about 44.7 degrees at 622 MHz, and about 39.6 degrees at 698 MHz.

Figure 23:
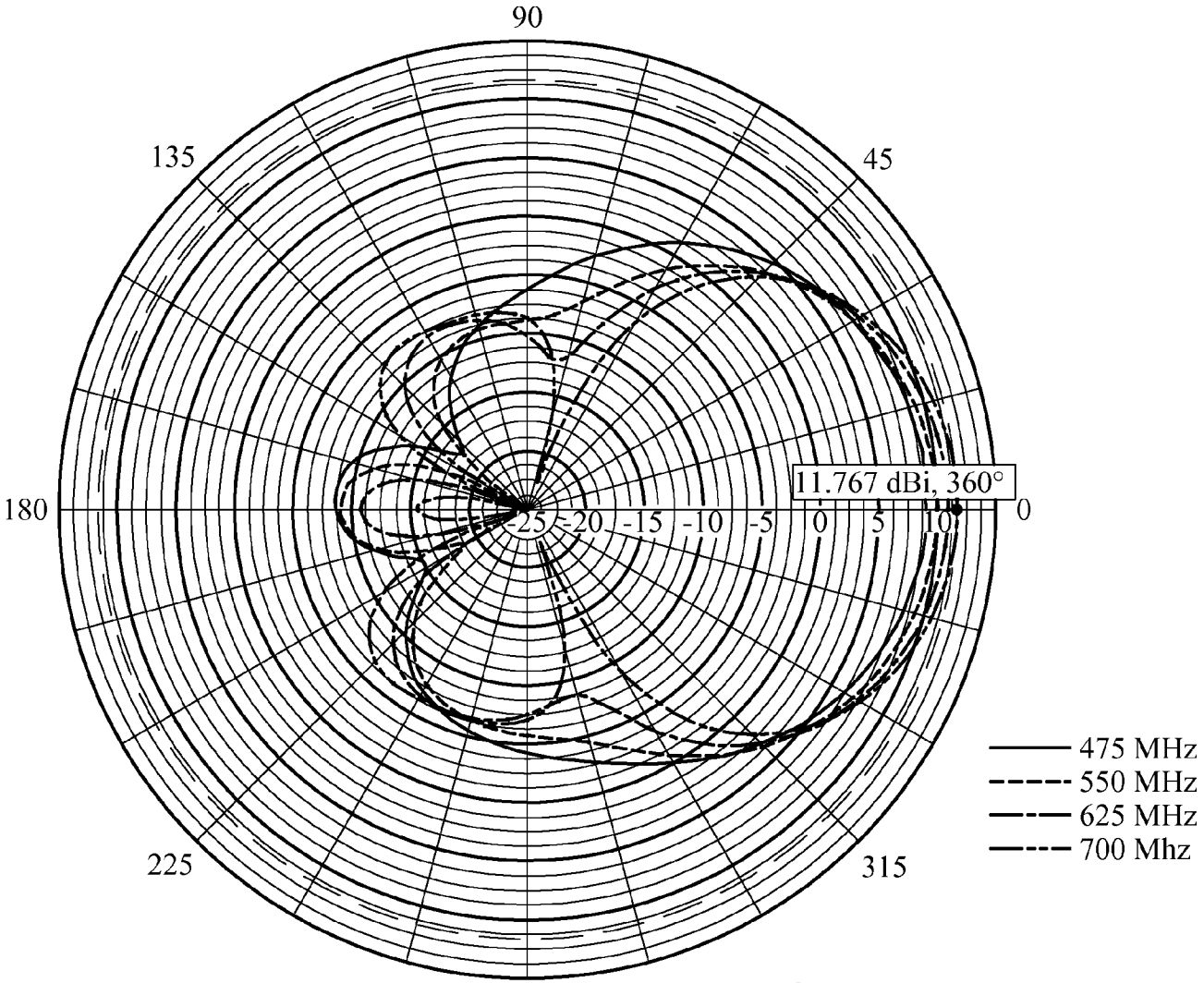
FIG. 23 is an exemplary line graph showing computer-simulated gain (dBi) versus elevation angle at various frequencies (MHz) for the antenna assembly shown in FIG. 1.

FIG. 23 is an exemplary line graph showing computer-simulated gain (dBi) versus elevation angle at various frequencies (MHz) for the antenna assembly 100. The performance data included elevation values (half power beam width) of about 68 degrees at 470 MHz, about 61 degrees at 546 MHz, about 59 degrees at 622 MHz, and about 54 degrees at 698 MHz.

Figure 24:
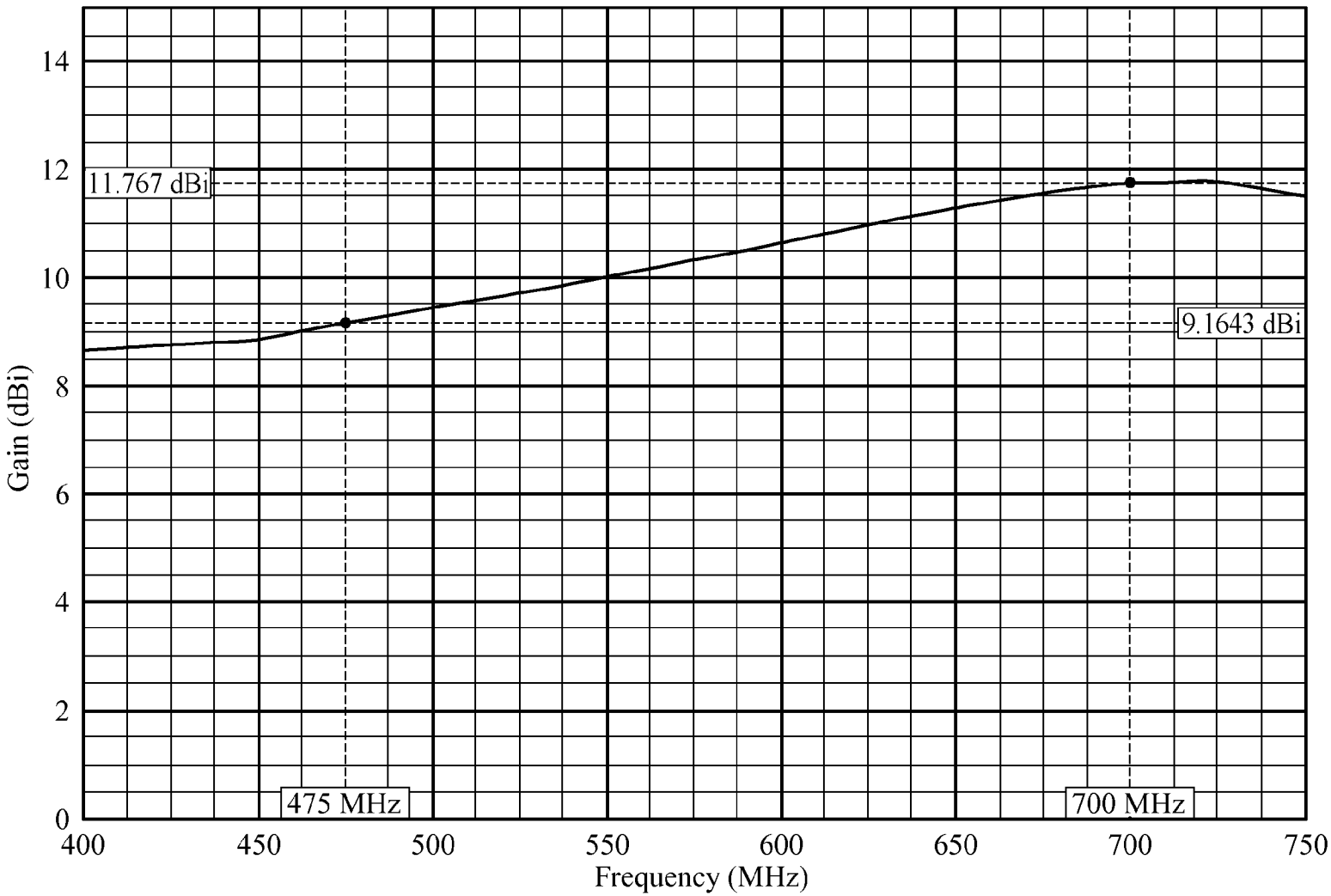
FIG. 24 is an exemplary line graph showing computer-simulated boresight gain (dBi) versus frequency (MHz) for the antenna assembly shown in FIG. 1.

FIG. 24 is an exemplary line graph showing computer-simulated boresight gain (dBi) versus frequency (MHz) for the antenna assembly 100. FIG. 24 generally shows that the antenna assembly 100 has relatively high gain from about 470 MHz to about 698 MHz. In addition, FIG. 24 also shows that the antenna assembly 100 has a peak gain of about 11.8 dBi at 698 MHz. Also, the boresight gain was about 9.06 dBi at 470 MHz, about 9.92 dBi at 546 MHz, about 10.9 dBi at 622 MHz, and about 11.73 dBi at 698 MHz.

Figure 25:
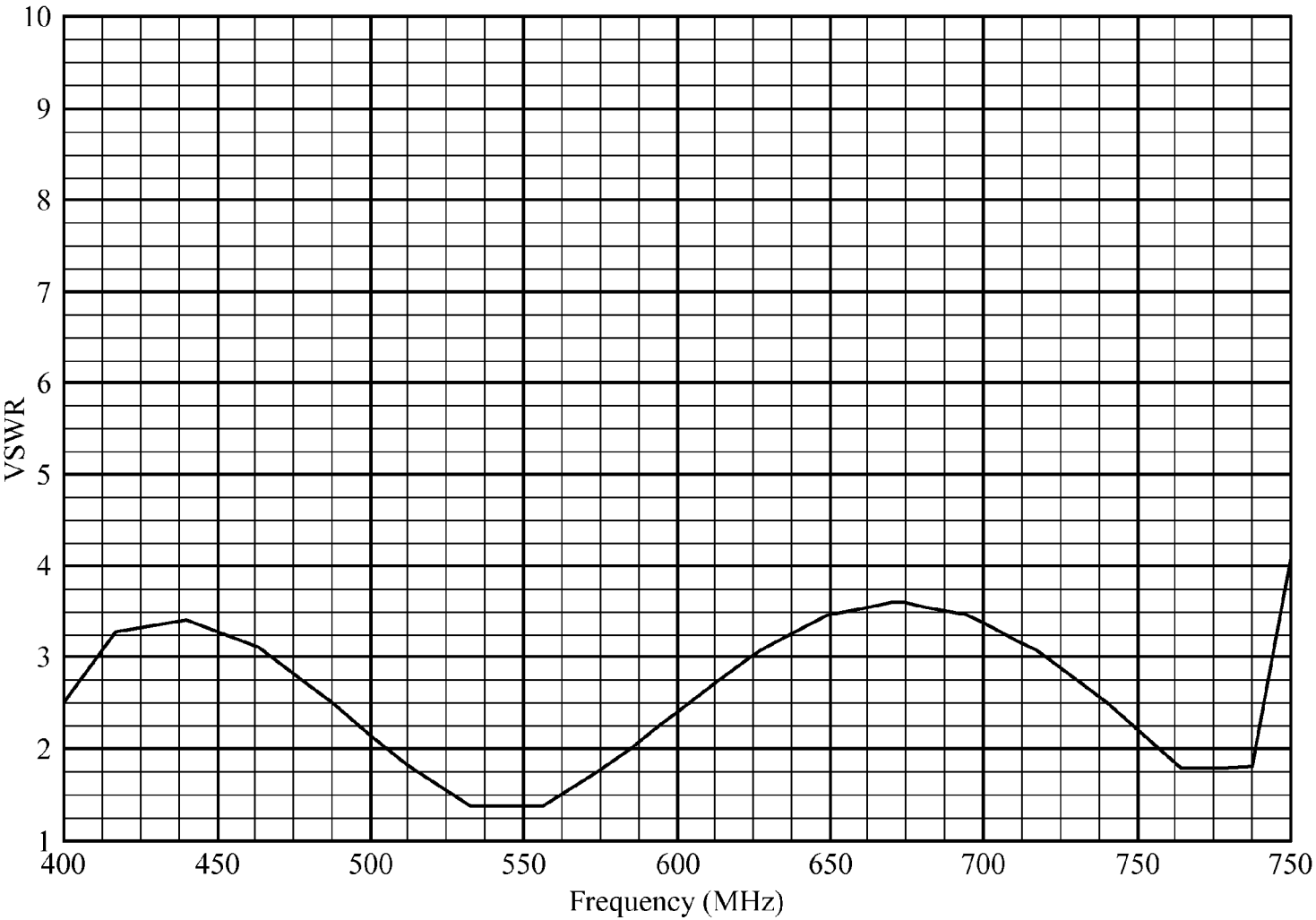
FIG. 25 is an exemplary line graph showing computer-simulated voltage standing wave ratio (VSWR) versus frequency (MHz) for the antenna assembly shown in FIG. 1.
Figure 26:
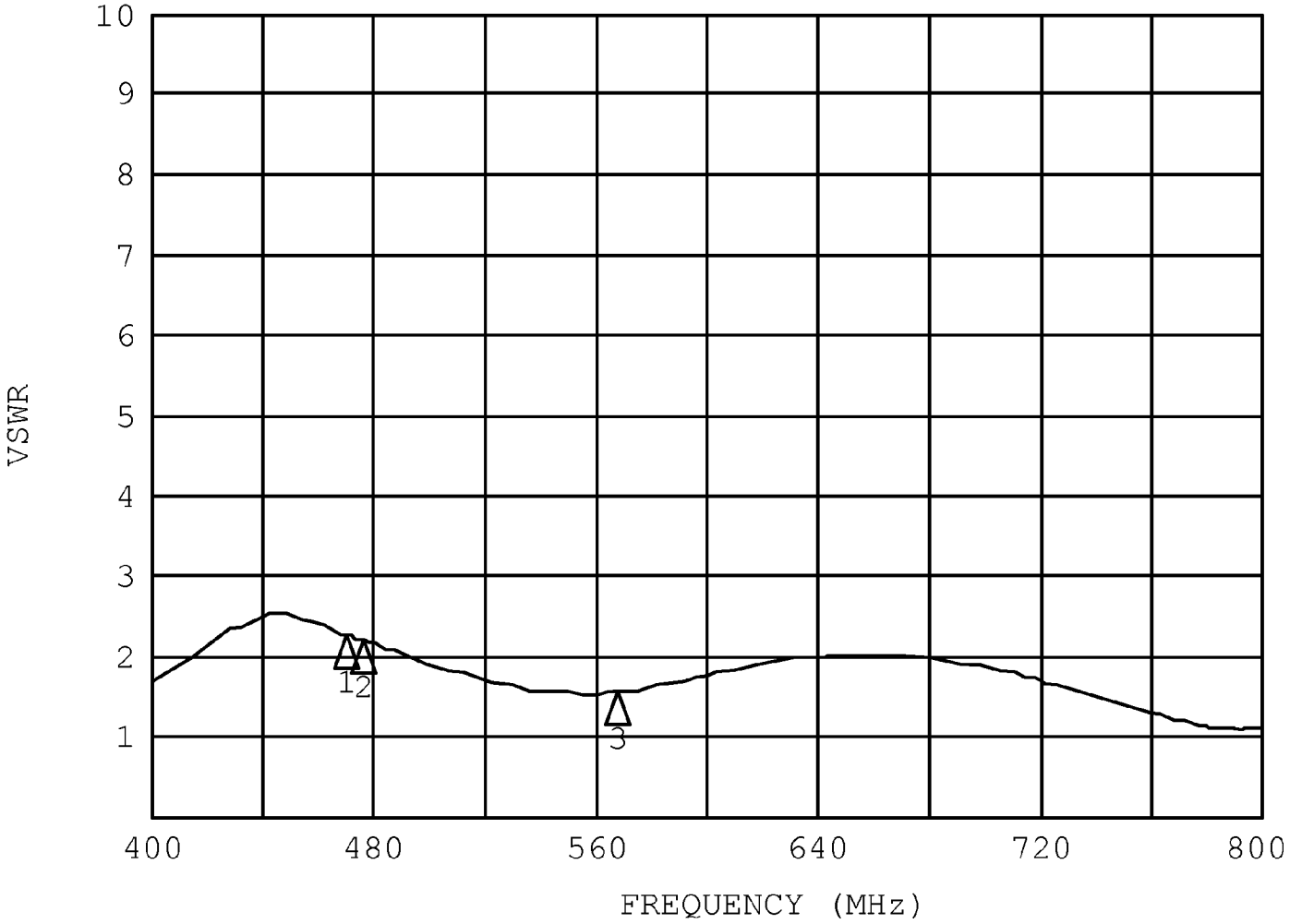
FIG. 26 is an exemplary line graph showing measured VSWR versus frequency (MHz) as measured outdoors for the antenna assembly shown in FIG. 3 on a ten foot mast above a concrete pad.

FIG. 25 is an exemplary line graph showing computer-simulated voltage standing wave ratio (VSWR) versus frequency (MHz) for the antenna assembly 100. FIG. 26 is an exemplary line graph showing measured VSWR versus frequency (MHz) as measured outdoors for the antenna assembly 100 on a ten foot mast above a concrete pad. Generally, VSWR is the ratio of the maximum to minimum voltage on the antenna feeding line, where a perfectly impedance matched antenna has a VSWR of 1:1. With further reference to FIG. 26, the VSWR of the antenna assembly 100 is about 2.2595 at 470 MHz (marker 1), about 2.2133 at 476 MHz (marker 2), and about 1.5677 at 568 MHz (marker 3). The performance data as measured outdoors revealed a maximum VSWR of no more than about 3.0 between 470 MHz and 698 MHz.

With further regard for the performance characteristics of the antenna assembly 100, this exemplary embodiment of the antenna assembly 100 has a peak gain of 12 dBi, and a front to back ratio greater than 18 dBi. Also, this exemplary antenna assembly 100 had a strong performance across the digital television (DTV) spectrum as shown by the line graphs in FIGS. 22 through 26. This exemplary antenna assembly 100 also includes an all-weather balun, flexible aiming characteristic, 60 degree beam-width, and is capable of being used indoors, outdoors, or in an attic. The antenna assembly 100 may also have a range of greater than forty-five miles and/or may have the following example dimensions including a width of 23 inches, a height of 16.25 inches, and a depth of 7 inches.

FIGS. 27 through 35 illustrate another embodiment of an antenna assembly 200 embodying one or more aspects of the present disclosure. As shown in FIG. 27, the antenna assembly 200 includes a first or lower pair of vertically spaced apart bow tie antennas 204, 214 and a second or upper pair of vertically spaced apart bow tie antennas 274, 284.

In this example, the bow tie antennas 204, 214, 274, 284 are identical to each other and identical to the bow tie antennas 104, 114 shown in FIGS. 1 through 10 and as described above. Accordingly, the above description of the bow tie antennas 104, 114 is also applicable to common features of the bow tie antennas 204, 214, 274, 284 of the antenna assembly 200. For example, the bow tie antennas 204, 214, 274, 284 may include antenna elements and connectors identical to or similar to the antenna element 107 shown in FIG. 11 and connector 111 shown in FIG. 12.

With continued reference to FIGS. 27 through 35, the bow tie antennas 204, 214 of the first pair are symmetrically arranged in a generally coplanar manner on the antenna support 210. The bow tie antennas 274, 284 of the second pair are also symmetrically arranged in a generally coplanar manner on the antenna support 210. The second pair of bow tie antennas 274, 284 is offset from or above the first pair of bow tie antennas 204, 214.

Figure 18A:
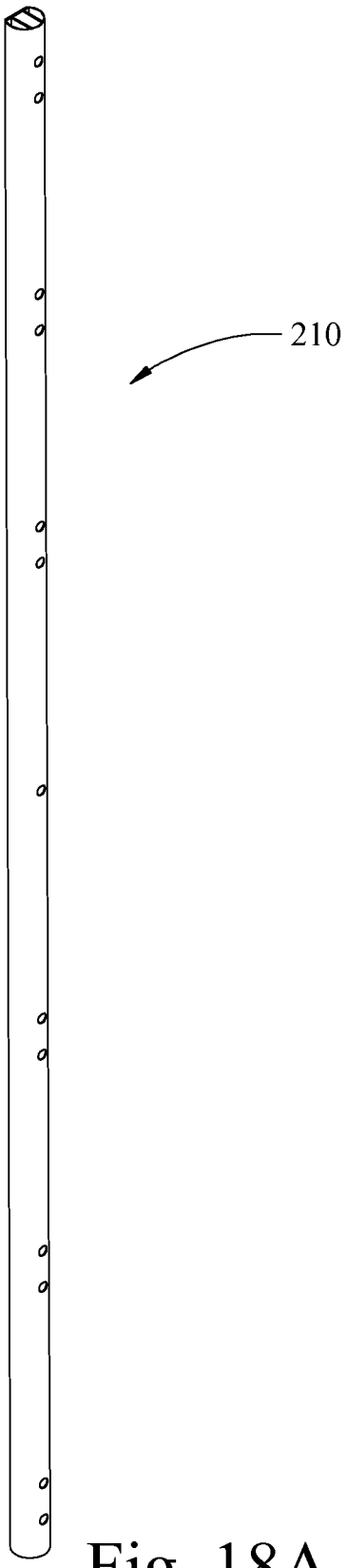
Figure 18B:
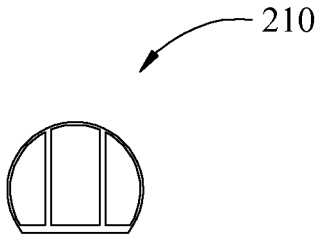

By way of example only, FIGS. 18A and 18B illustrate an example antenna support 210 to which the bow tie antennas 204, 214, 274, 284 may be mounted. As shown in FIGS. 18A and 18B, the illustrated antenna support 210 has a D-shaped cross section with interior ribs or strengthening members, although other configurations may also be used (e.g., circular cross section, rectangular cross section, etc.). The antenna support 210 may be formed from a wide range of materials, such as aluminum, other electrically conductive metal, etc.

A first or lower reflector 250 is coupled to the antenna support 210, such that the first reflector 250 is offset from and disposed behind the first pair of bow tie antennas 204, 214. A second or upper reflector 252 is also coupled to the antenna support 210. But the second reflector 252 is offset from and disposed behind the second pair of bow tie antennas 274, 284.

The antenna assembly 200 further includes a transformer (e.g., a printed circuit board (PCB) balun, etc.) concealed under and/or housed within the housing 220. In this example, the housing 220 is identical to the housing 120 shown FIGS. 1-10 and 13 and as described above. Accordingly, the above description of the housing 120 is also applicable to common features of the housing 120. Accordingly, the antenna assembly 200 may also include a housing 220 in which a transformer may be housed such that the antenna assembly 200 includes an all-weather balun.

Antenna mounting members 240 are used to couple (e.g., mount, attach, etc.) the bow tie antennas 204, 214, 274, 284 to the antenna support 210. In this example, the antenna mounting members 240 are identical to the antenna mounting members 140 shown FIGS. 1-10 and 14 and as described above. Accordingly, the above description of the antenna mounting members 140 is also applicable to common features of the antenna mounting members 240 of the antenna assembly 200. For example, each mounting member 240 may include a recessed or slotted portion 242 (FIG. 27) configured to mount against the antenna support 210, and may be secured to the antenna support 210 via one or more mechanical fasteners (e.g., screws, rivets, etc.) or other suitable attachment means. In addition, the antenna mounting members or supports 240 are also configured (e.g., with recessed portions or slots, etc.) for providing a stop for angled end portions of transmission lines (e.g., transmission lines 122 in FIG. 1, etc.) and for providing a stop for straight end portions of transmission lines (e.g., straight transmission lines shown in FIG. 27, etc.). Alternative embodiments may include other means for mounting the bow tie antennas 204, 214, 274, 284 to the antenna support 210.

The antenna assembly 200 may be used atop a house (e.g., mounted above a rooftop, etc.) for receiving digital television signals (of which high definition television (HDTV) signals are a subset) and communicating the received signals to an external device, such as a high definition flat screen television inside a home. In a similar manner as described above for antenna assembly 100 and shown in FIG. 4, a coaxial cable may be used for transmitting signals received by the antenna assembly 200 to a television. Alternative embodiments may include an antenna assembly positioned within an interior of a building or residence. In one example, the antenna assembly 200 may include a 75-ohm RG6 coaxial cable fitted with an F-Type connector (although other suitable communication links may also be employed). Alternative embodiments may include other coaxial cables or other suitable communication links (e.g., a seventy-five ohm unbalanced coaxial feed, a 300 ohm balanced twin lead, etc.).

Each bow tie antenna 204, 214, 274, 284 includes two generally elongated triangular or trapezoidal shaped antenna elements arranged to cooperatively define or provide a generally bow tie shape for the antenna 204, 214, 274, 284. As shown in FIG. 27, the bow tie antenna 204 includes antenna elements 206, 208. The bow tie antenna 214 includes the antenna elements 216, 218. The bow tie antenna 274 includes the antenna elements 275, 277. The bow tie antenna 284 includes antenna elements 285, 287. The antenna elements 206, 208, 216, 218, 275, 277, 285, 287 may comprise electrically-conductive wire, rod, hollow tubing, or other suitable electrical conductors formed to have an outer periphery or perimeter defining the triangular or trapezoidal shaped antenna elements. The antenna elements 207, 208, 216, 218, 275, 277, 285, 287 may each form a triangle having an open end or open portion which will be towards the outside of the bow tie shape when assembled, and having a closed end or closed portion which will be towards a middle or center of the bow tie shape when assembled. The spaced apart end portions of each antenna element may be connected (e.g., by a piece of dielectric tubing or tubular member 211, etc.).

A wide range of materials and manufacturing processes may be used for the bow tie antennas 204, 214, 274, 284. By way of example only, the bow tie antennas 204, 214, 274, 284 and/or triangular or trapezoidal shaped antenna elements thereof may be formed from an electrically conductive material, such as aluminum, copper, stainless steel, other metals, alloys, etc. In another embodiment, the bow tie antennas 204, 214, 274, 284 and/or triangular or trapezoidal shaped antenna elements thereof may be stamped from sheet metal.

The first and second reflector elements 250, 252 are coupled to the support 210. The reflector elements 250, 252 include generally flat or planar surfaces. The first reflector element 250 is offset behind or separated by a predetermined distance from the first pair of bow tie antennas 204, 214, such that the first reflector element 250 is generally operable for reflecting electromagnetic waves generally towards the first pair of bow tie antennas 204, 214. The second reflector element 252 is offset behind or separated by a predetermined distance from the second pair of bow tie antennas 274, 284, such that the second reflector element 252 is generally operable for reflecting electromagnetic waves generally towards the second pair of bow tie antennas 274, 284.

A second reflector element 252 is offset behind or separated by a predetermined distance from the second pair of spaced apart bow tie antennas 274, 284. The first and second reflector elements 250, 252 are coupled to the antenna support 210, as illustrated in FIG. 27. The reflector element 250 includes a generally flat or planar surface. The reflector 250 may be generally operable for reflecting electromagnetic waves generally towards the bow tie antennas.

In regard to the size of the reflectors 250, 252 and spacing relative to the bow tie antennas 204, 214, 274, 284, the inventors hereof have recognized that the size of the reflector elements 250, 252 and spacing relative to the antennas 204, 214, 274, 284 strongly impact performance. Placing the bow tie antennas 204, 214, 274, 284 too close to the respective reflector elements 250, 252 provides an antenna with good gain, but may result in a narrow impedance bandwidth and poor voltage standing wave ratio (VSWR). If the bow tie antennas 204, 214, 274, 284 are placed too far away from the reflector elements 250, 252, the gain may be reduced due to improper phasing. When the size and proportions of the bow tie antennas 204, 214, 274, 284, the reflector size, and spacing between the reflector elements and bow tie antennas are properly chosen, there is an optimum or improved configuration that takes advantage of the near zone coupling with the reflector elements to produce enhanced impedance bandwidth, while mitigating the effects of phase cancellation. The net result is an exemplary balance between impedance bandwidth, directivity or gain, radiation efficiency, and physical size. In this example, the reflector element 250 is offset by a distance of about 124 millimeters from the bow tie antennas 204, 214, to separate the reflector's planar surface from the surface of the antennas 204, 214. Also in this example, the reflector element 252 is offset by a distance of about 124 millimeters from the bow tie antennas 274, 284, to separate the reflector's planar surface from the surface of the antennas 274, 284. The dimensions in this paragraph (as are all dimensions disclosed herein) are provided for illustrative purposes only.

In this illustrated embodiment, the reflector elements 250, 252 are generally rectangular in shape. Each reflector element 250, 252 include a grill or wire mesh surface 260, 263. In addition, the reflector element 250, 252 may include reflector support 262 disposed on, along, or adjacent the mesh surfaces 260, 263 to provide reinforcement to the mesh surfaces 260, 263 and/or a means for supporting or coupling the reflector elements 250, 252 to the antenna support 210.

Figure 19A:
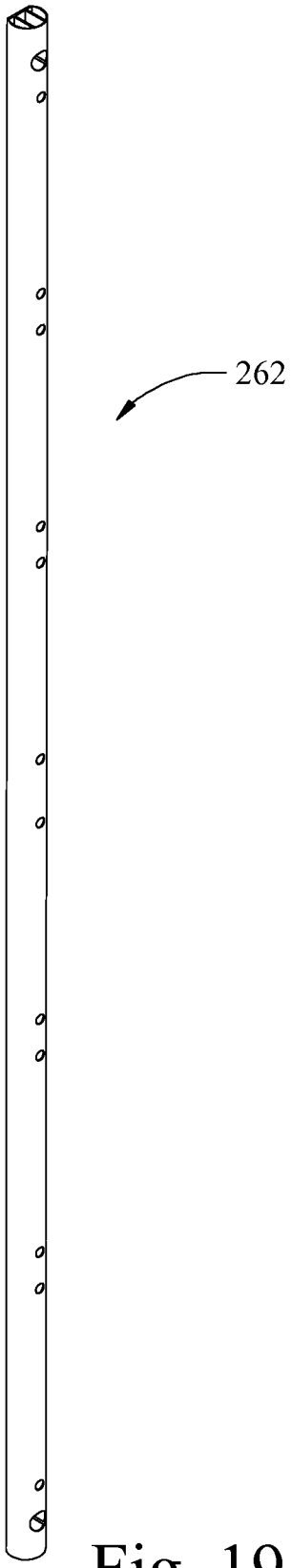
Figure 19B:
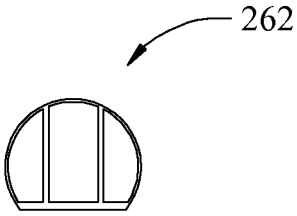

By way of example only, FIGS. 19A and 19B illustrate an example reflector support 262. As shown in FIGS. 19A and 19B, the illustrated reflector support 262 has a D-shaped cross section with interior ribs or strengthening members, although other configurations may also be used (e.g., circular cross section, rectangular cross section, etc.). The reflector support 262 may be formed from a wide range of materials, such as aluminum, other electrically conductive metal, etc.

By way of further example only, each reflector element 250, 252 may be configured to have a width (from left to right in FIG. 27) of about 23 inches, a height (from top to bottom in FIG. 27) of about 16.25 inches, and be offset from the bow tie antennas 204, 214, 274, 284 such that the antenna assembly 200 has an overall height of 37.5 inches and an overall depth of about 7 inches from the front surface of the bow tie antennas to the back of the reflectors' mesh surfaces 260, 263.

A wide range of materials may be used for the reflector elements 250, 252. In an exemplary embodiment, the reflector elements 250, 252 include powder coated steel. Alternative embodiments may include a differently configured reflector (e.g., different material, etc.), such as a reflector made of stainless steel, aluminum, or anti-corrosion treated copper. Spaces or notches may also be provided in the reflectors 250, 252 to facilitate mounting of the reflectors or antenna assembly 200. Alternative embodiments may have reflectors without such spaces or notches.

In an exemplary embodiment, the antenna assembly 200 includes a printed circuit board having the balun, which is operable for converting a balanced line into an unbalanced line. The balun may be coupled to the antenna support 210 between the first and second pairs or sub arrays of bow tie antennas 204, 214, 274, 284 such that the balun is equidistant from the upper and lower subarrays to ensure that the bow tie antennas are in phase.

Figure 21:
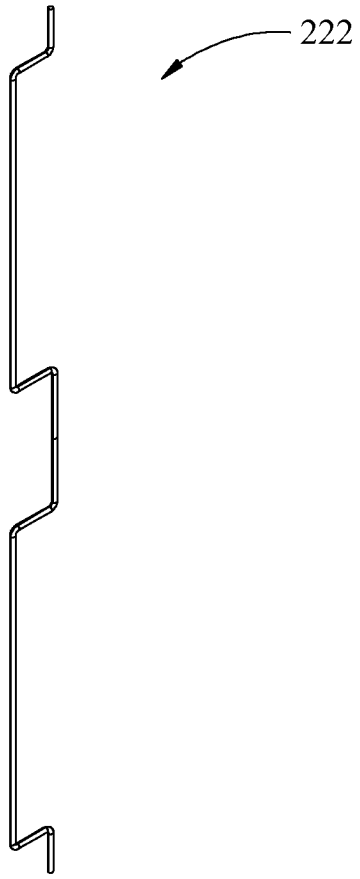

The balun may be electrically connected to the bow tie antennas 204, 214, 274, 284 via one or more pairs of wires or electrical conductors 222 that extend between the balun and bow tie antennas 204, 214, 274, 284. By way of example only, FIG. 21 illustrates an example electrical conductor 222 (e.g., bent or shaped wire, etc.) that be used in the antenna assembly 200. As disclosed above, the wires 122 on the two bow tie antenna element array are bent inwards in such a way over part of their length so as to create an impedance transformer and effect an improved impedance match at the feed point (balun) of the antenna assembly 100. In the case of the four bow tie element array 200, a corporate feed is used. The wires connecting each two bow tie element sub array are straight while wires connecting to the balun are bent towards the corresponding reflector and then back toward the balun in a way that maintained constant characteristic impedance throughout the array. Moreover, the use of the corporate feed structure maintains phasing of all elements across frequencies both in and outside the passband of the antenna assembly. Conventional low cost four element bow tie arrays use a single feed line to connect all elements with a twist is introduced in the line to maintain uniform phasing. But this twist method only achieves ideal phasing at or near the center of the passband. At frequencies below the passband, the twist introduces a phase shift which tends to cause a cancellation effect on each pair of elements. This dramatically reduces gain for VHF television channels. The corporate feed used in embodiments of the inventors' antenna assemblies tends to maintain uniform phasing across a wider range of frequencies and enhance performance when receiving VHF signals.

The antenna mounting members, supports, or pieces used to mount the bow tie antenna elements are also designed in such a way to provide proper support for both a two element configuration (e.g., antenna assembly 100 etc.) with narrow spacing as well as the four element configuration (e.g., antenna assembly 200, etc.) with uniform wide spacing. The antenna mounting members, supports, or pieces (e.g., antenna mounting members 140, 240, etc.) may also be configured in such a way to provide proper support for both a two element configuration (e.g., antenna assembly 100 etc.) with narrow spacing as well as the four element configuration (e.g., antenna assembly 200, etc.) with uniform wide spacing. For example, and as shown in FIG. 1, the antenna mounting members 140 are configured for providing a stop for angled end portions of the transmission lines 122 in the two bow tie antenna element assembly or array 100. And as shown in the example of FIG. 27, the antenna mounting members 240 are also configured for providing a stop for straight end portions of transmission lines in the four bow tie antenna element assembly or array 200.

Alternative embodiments may include different means for connecting the balun to the bow tie antennas 204, 214, 274, 284. The antenna assembly 200 may further include a connector (not shown) for connecting a coaxial cable 226 (FIG. 28) or other communication link or line to the antenna assembly 200.

Figure 28:
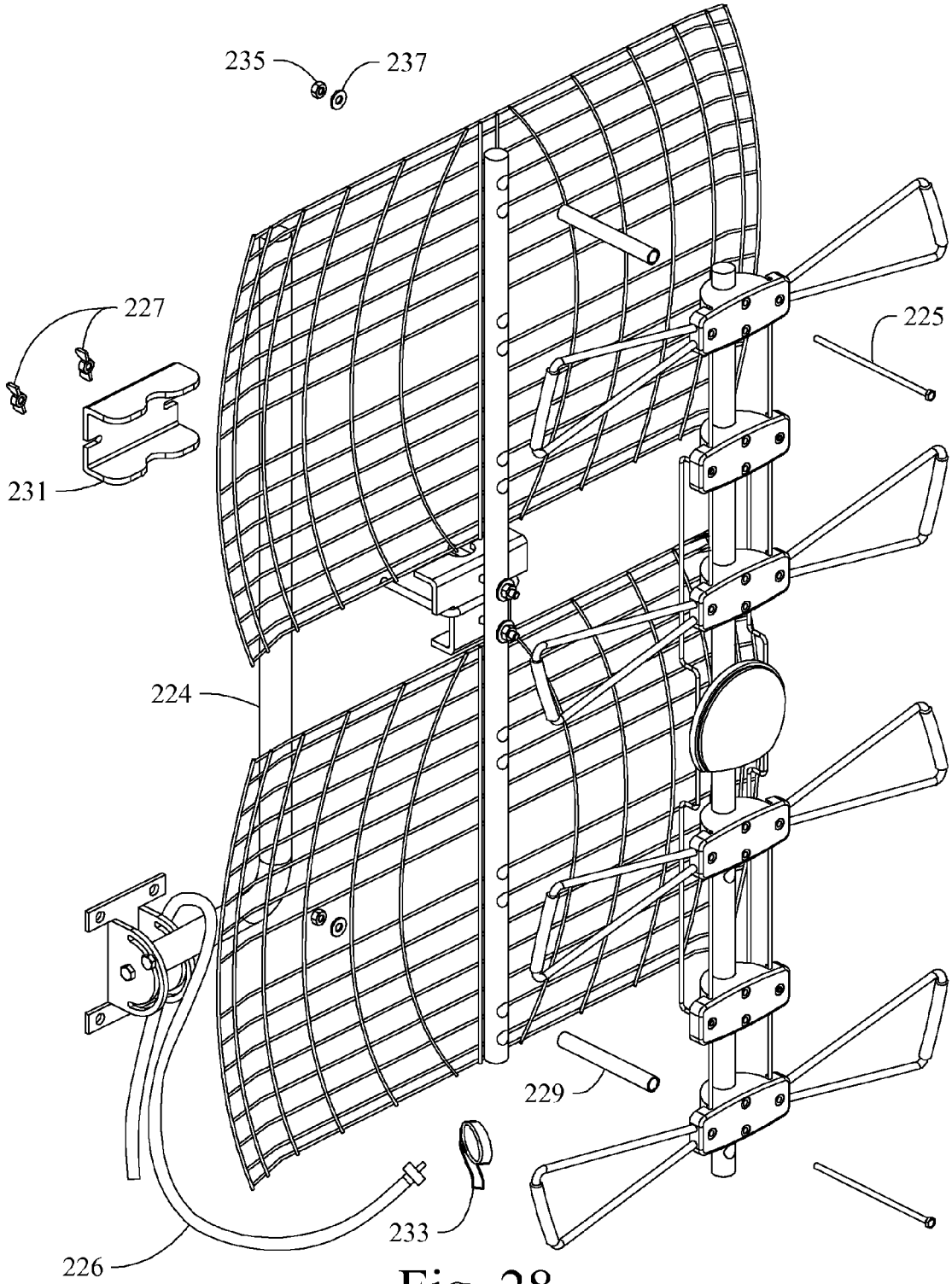
FIG. 28 is an exploded perspective of the antenna assembly shown in FIG. 27 and illustrating an exemplary manner by which the antenna assembly may be assembled and mounted to a mast according to an exemplary embodiment.
Figure 29:
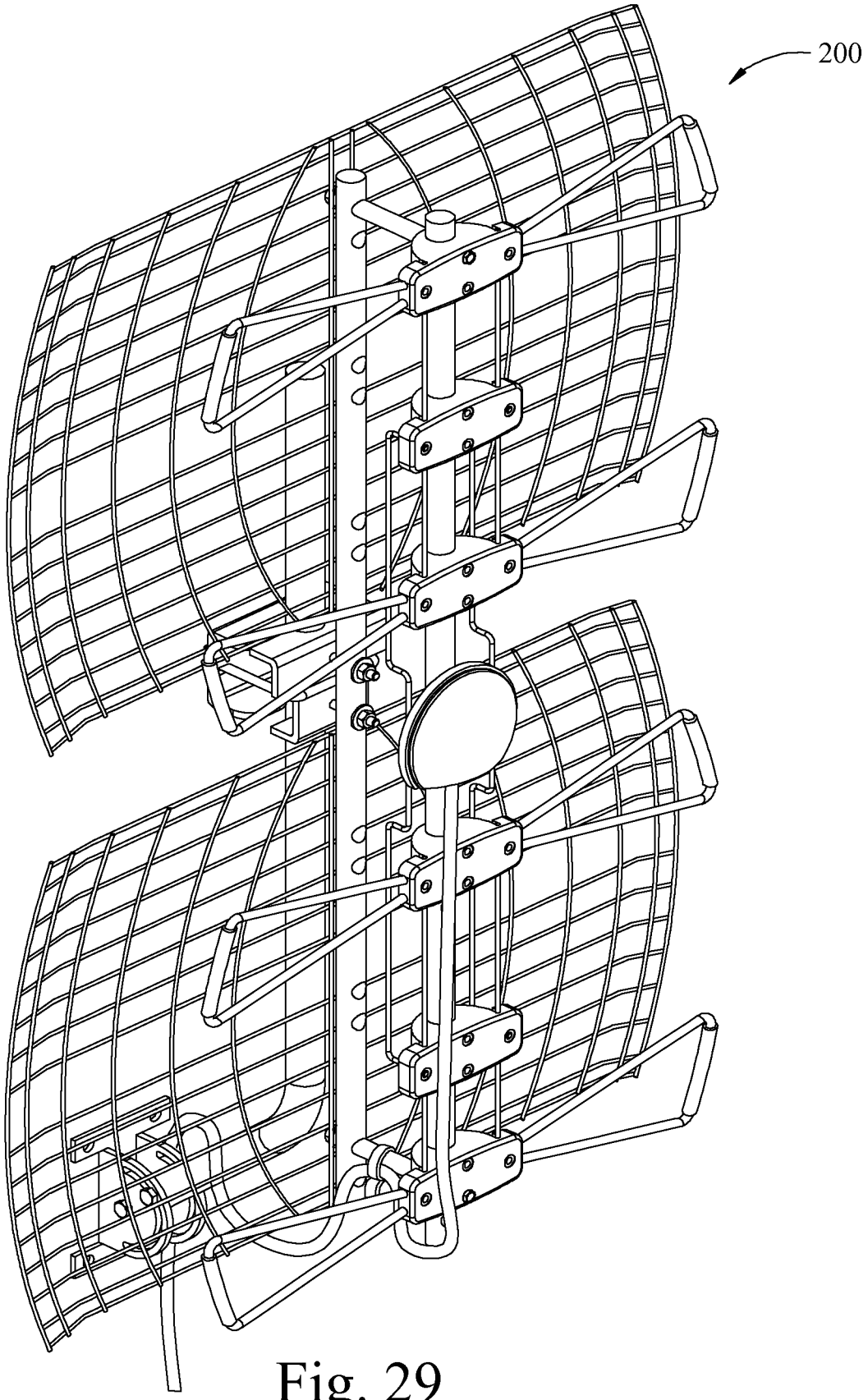
FIG. 29 is a perspective view illustrating the antenna assembly shown in FIG. 27 after being assembled and mounted to the mast.
Figure 30:
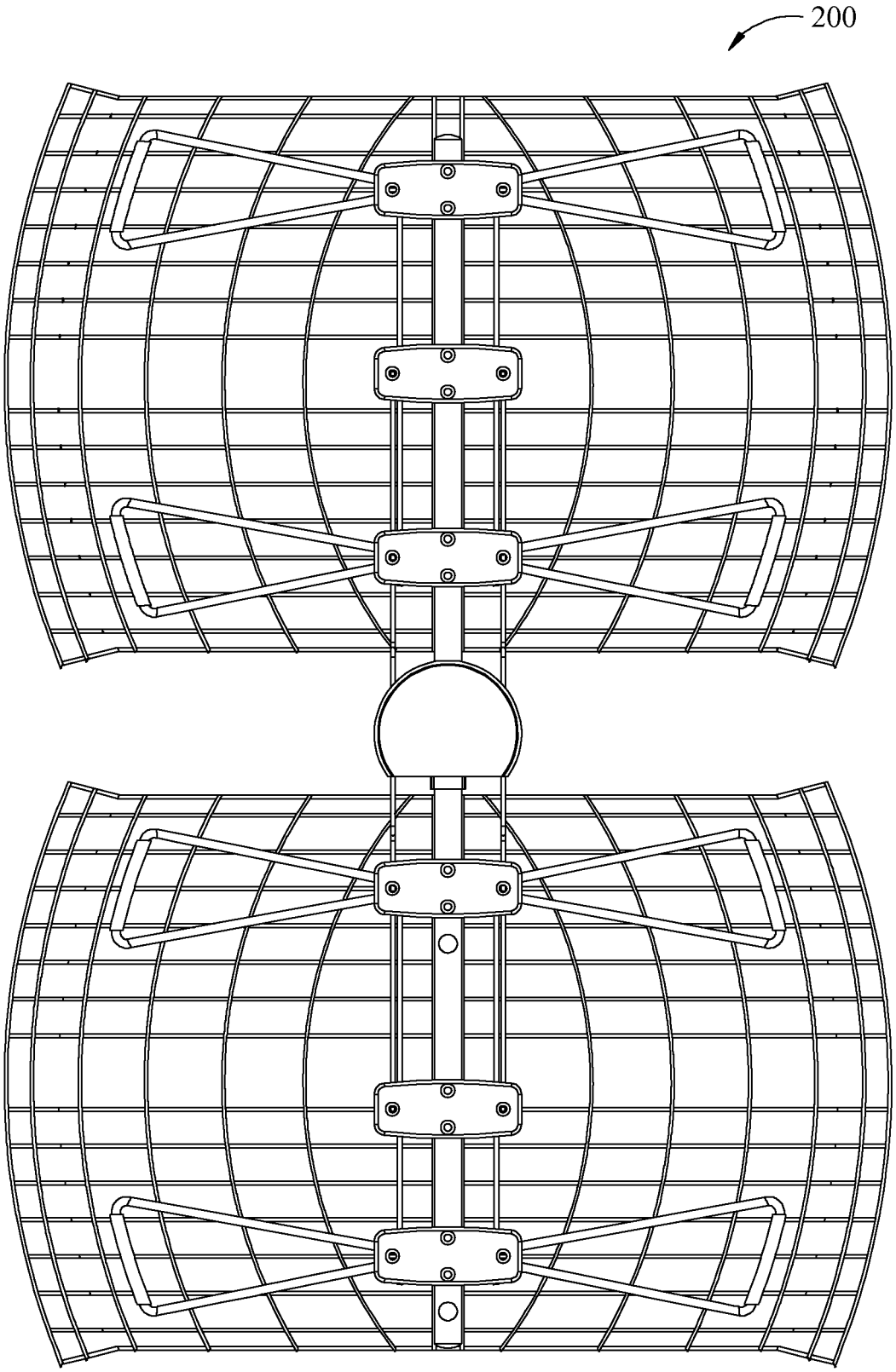
FIG. 30 is a front view of the antenna assembly shown in FIG. 27.
Figure 31:
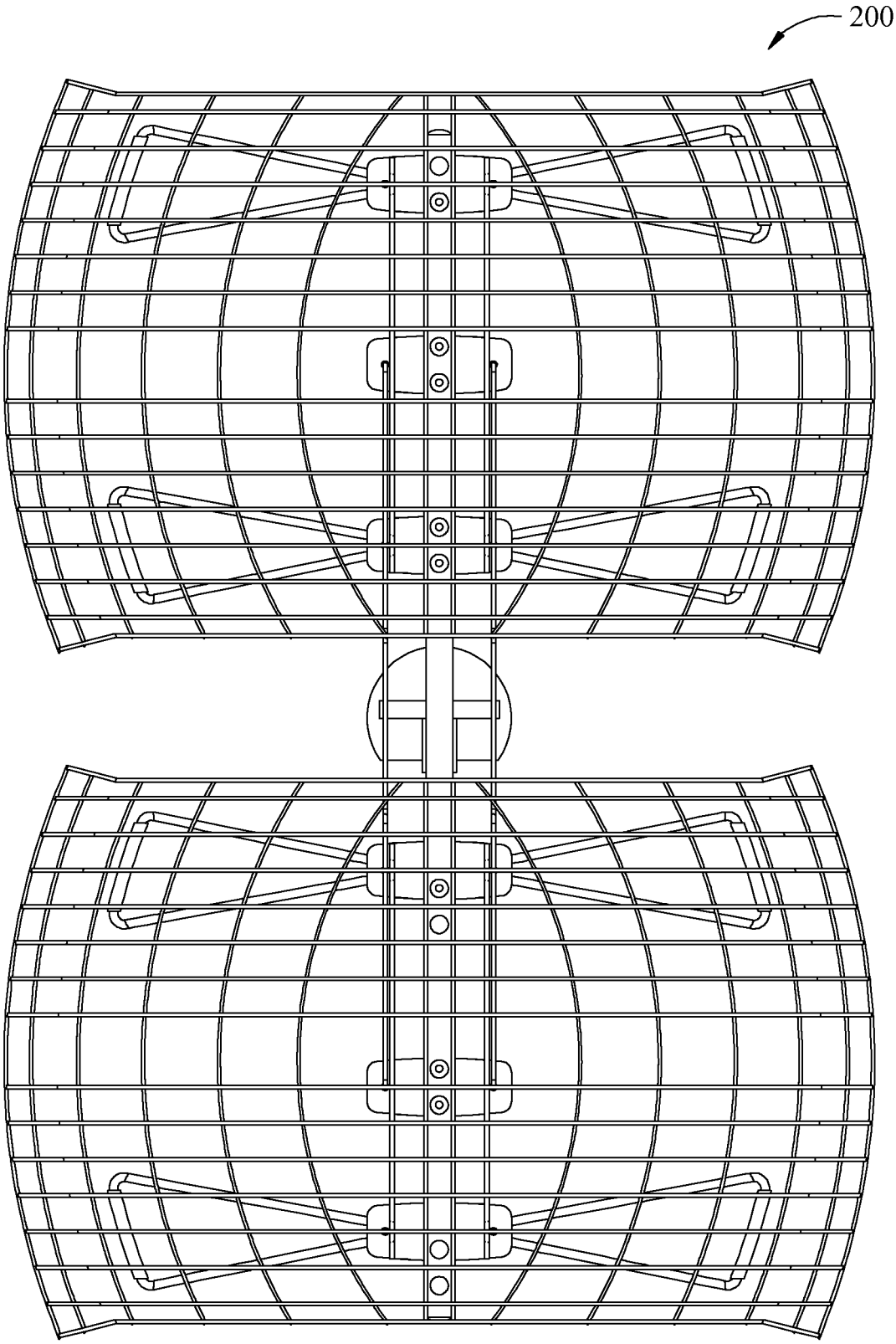
FIG. 31 is a back view of the antenna assembly shown in FIG. 27.
Figure 32:
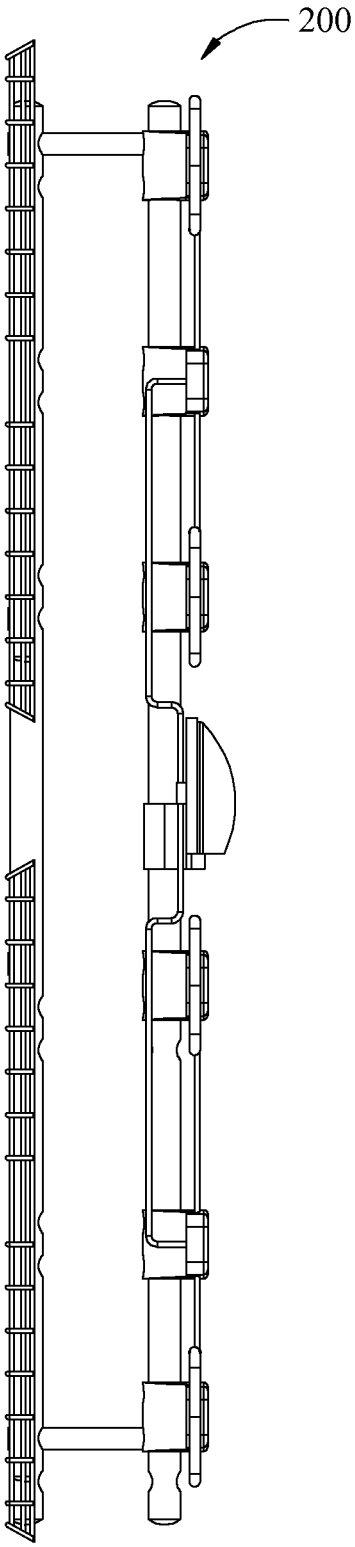
FIG. 32 is a left side view of the antenna assembly shown in FIG. 27.
Figure 33:
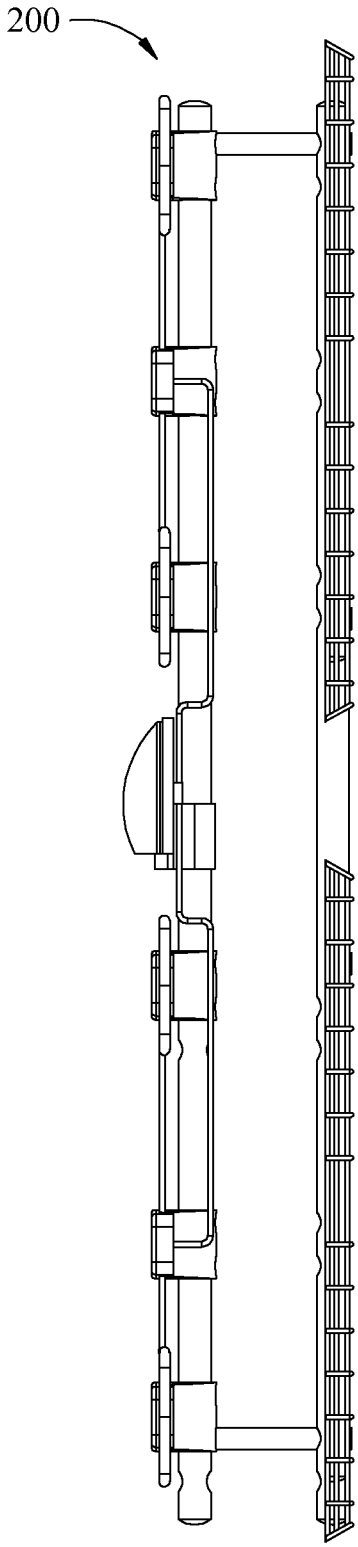
FIG. 33 is a right side view of the antenna assembly shown in FIG. 27.
Figure 34:
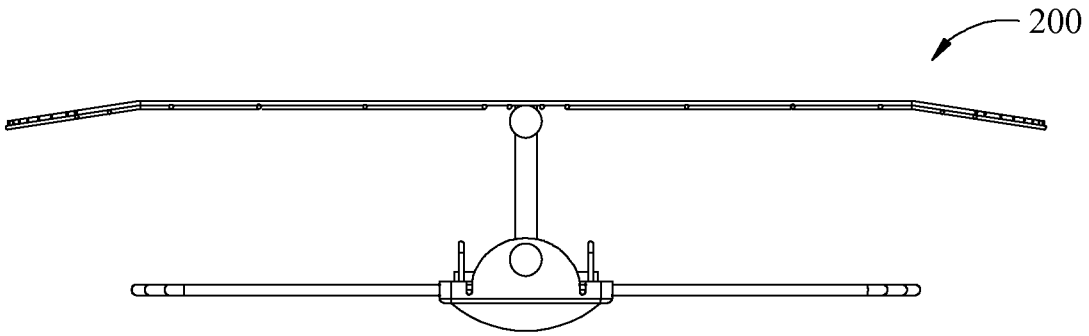
FIG. 34 is a top view of the antenna assembly shown in FIG. 27.
Figure 35:
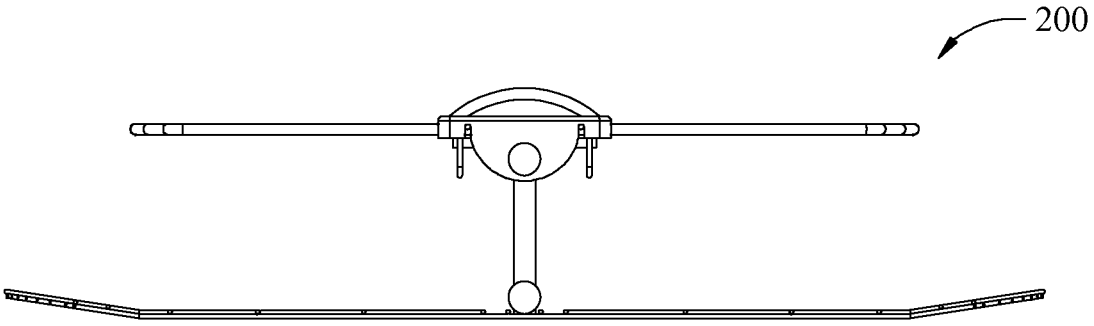
FIG. 35 is a bottom view of the antenna assembly shown in FIG. 27.

The antenna assembly 200 may be assembled and mounted to a mast 224 as shown in FIGS. 28 and 29. As shown in FIG. 28, this process includes the use of bolts 225, wing nuts 227, sleeves 229, mast clamps 231 (e.g., mast clamp 131 shown in FIGS. 15A and 15B, etc.), a zip tie 233, a nut 235, a washer 237, etc. But these fasteners for assembling and mounting the antenna assembly 200 are provided for purpose of illustration only as other embodiments may include different means and/or different processes for assembling and mounting an antenna assembly.

FIGS. 36 through 40 illustrate performance data measured for a prototype of the antenna assembly 200 shown in FIG. 27. In FIGS. 36 through 39, the computer-simulated performance data was obtained using a state-of-the-art simulator with the following assumptions of a perfect electrical conductor (PEC), free space, PCB balun included, and 75 ohm reference. The data and results shown in FIGS. 36 through 40 are provided only for purposes of illustration and not for purposes of limitation. Accordingly, an antenna assembly may be configured to have operational parameters substantially as shown in any one or more of FIGS. 36 through 40, or it may be configured to have different operational parameters depending, for example, on the particular application and signals to be received by the antenna assembly.

Electrical data for the antenna assembly 200 included a design pass band for UHF 470 MHz to 698 MHz with channels 14-51, a nominal impedance of 75 ohms, and an F-Female connector. In addition, the performance data included computer-based front-to-back ratio of boresight gain to maximum gain in the rear hemisphere based on the azimuth and elevation cuts of about 15.18 dB at 470 MHz, about 16.79 dB at 546 MHz, about 17.78 dB at 622 MHz, and about 17.05 dB at 698 MHz.

Figure 36:
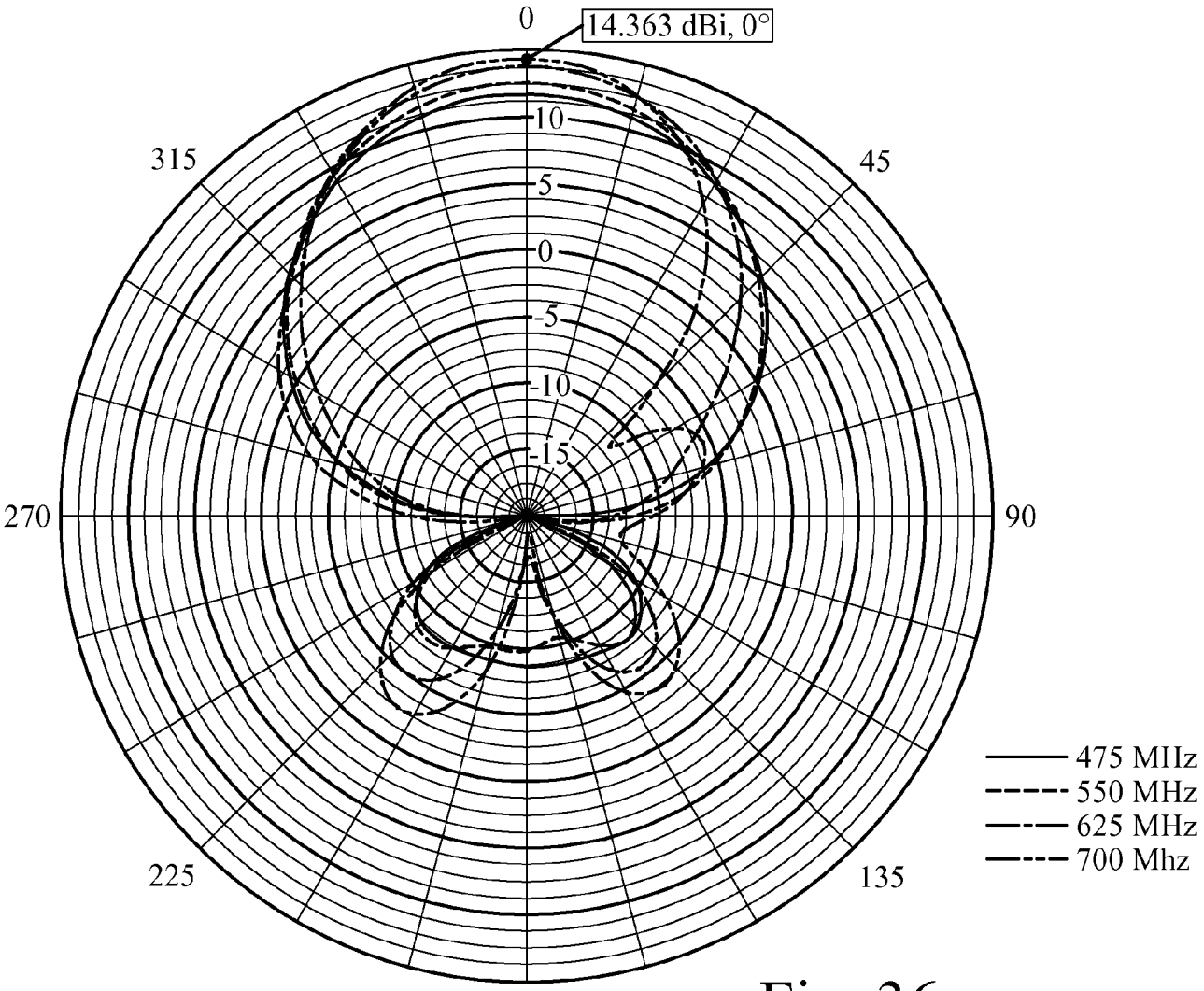
FIG. 36 is an exemplary line graph showing computer-simulated gain (dBi) versus azimuth angle at various frequencies (in megahertz (MHz)) for the antenna assembly shown in FIG. 27.

FIG. 36 is an exemplary line graph showing computer-simulated gain versus azimuth angle at various frequencies (in megahertz (MHz)) for the antenna assembly 200. The performance data included azimuth values (half power beam width) of about 60 degrees at 470 MHz, about 55.7 degrees at 546 MHz, about 47.5 degrees at 622 MHz, and about 42.1 degrees at 698 MHz.

Figure 37:
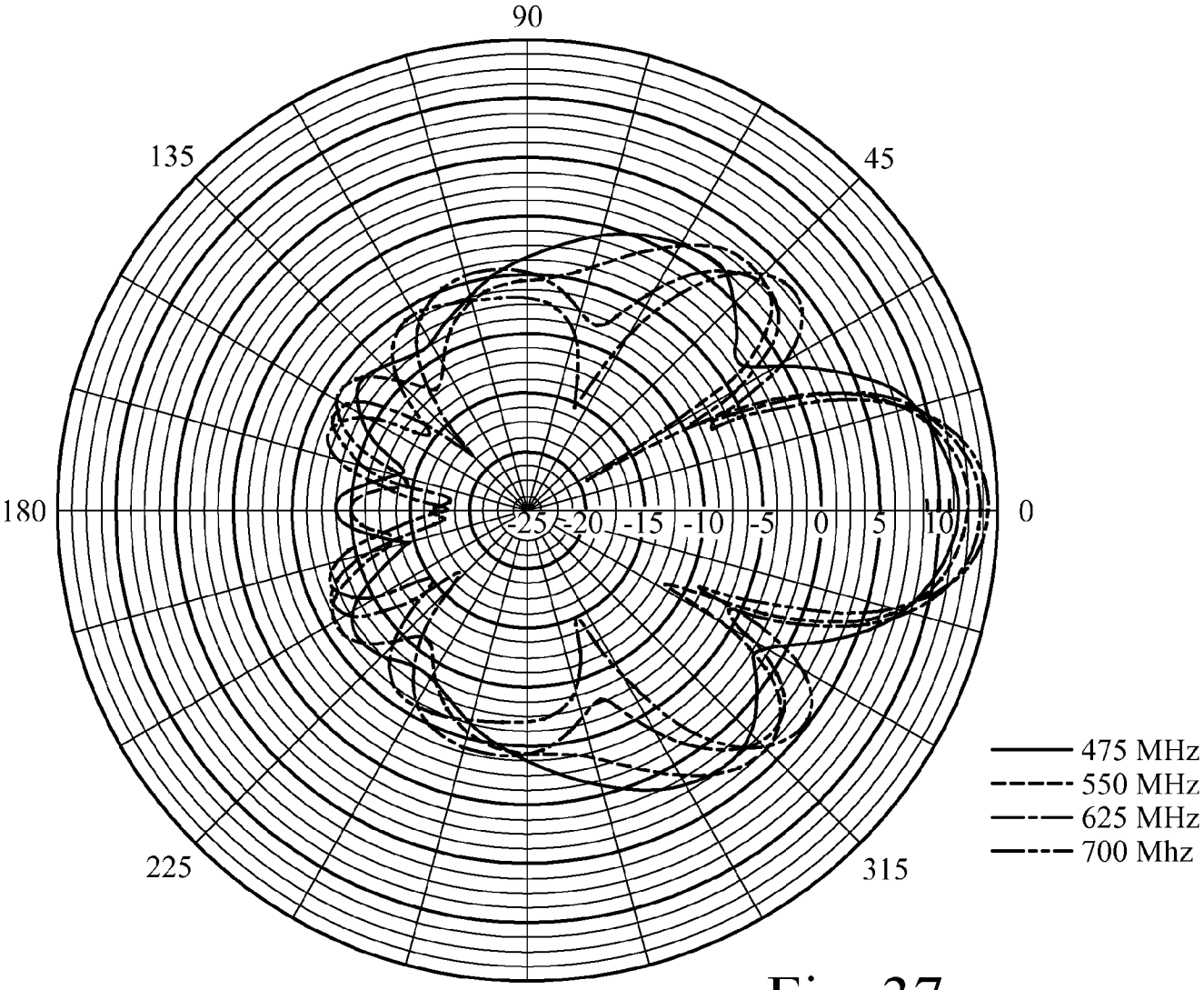
FIG. 37 is an exemplary line graph showing computer-simulated gain (dBi) versus elevation angle at various frequencies (MHz) for the antenna assembly shown in FIG. 27.

FIG. 37 is an exemplary line graph showing computer-simulated gain (dBi) versus elevation angle at various frequencies (MHz) for the antenna assembly 200. The performance data included elevation values (half power beam width) of about 30 degrees at 470 MHz, about 24.5 degrees at 546 MHz, about 24 degrees at 622 MHz, and about 21.5 degrees at 698 MHz.

Figure 38:
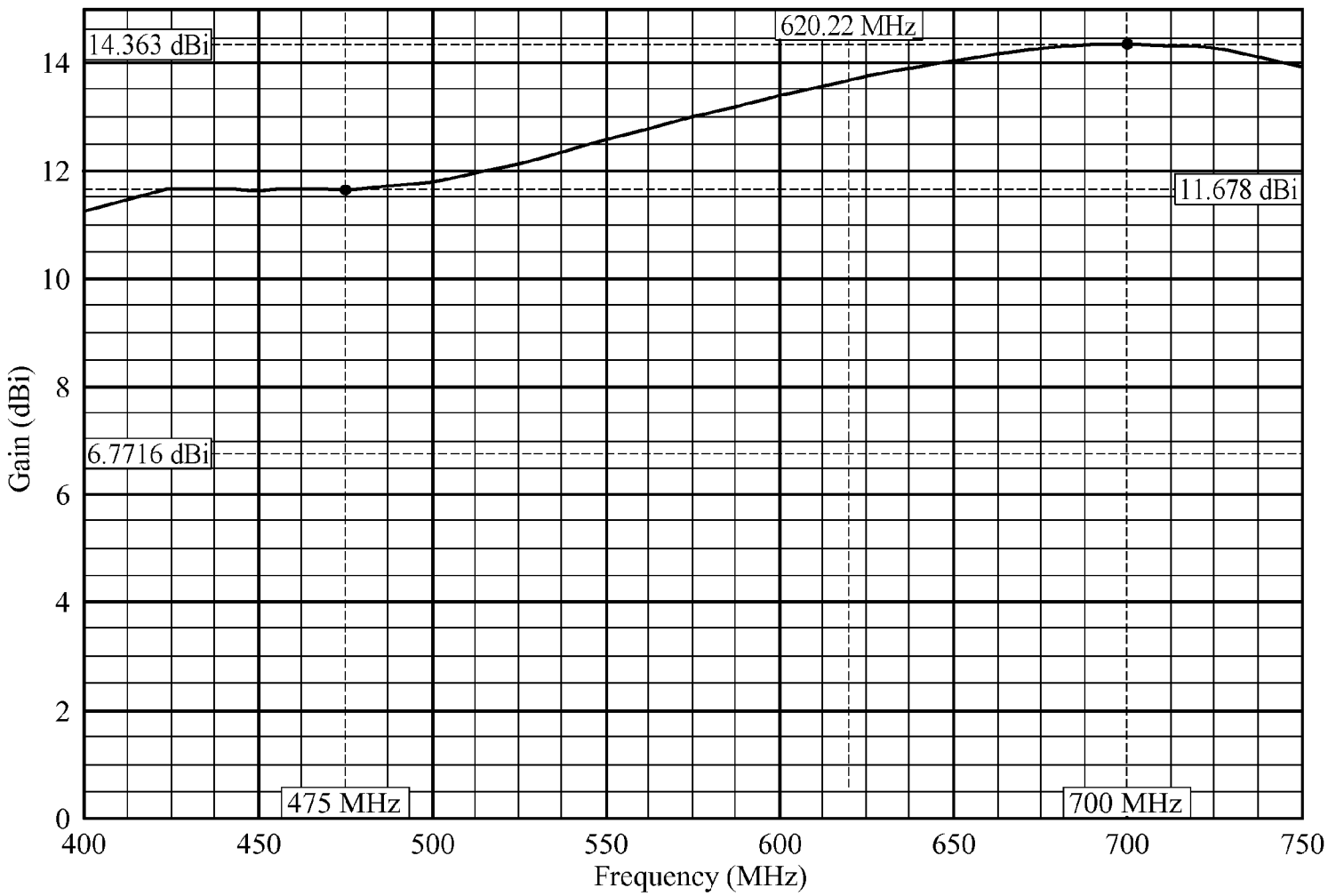
FIG. 38 is an exemplary line graph showing computer-simulated boresight gain (dBi) versus frequency (MHz) for the antenna assembly shown in FIG. 27.

FIG. 38 is an exemplary line graph showing computer-simulated boresight gain (dBi) versus frequency (MHz) for the antenna assembly 200. FIG. 38 generally shows that the antenna assembly 200 has relatively high gain from about 470 MHz to about 698 MHz. In addition, FIG. 38 also shows that the antenna assembly 200 has a peak gain of about 14.3 dBi at 698 MHz. Also, the boresight gain was about 11.68 dBi at 470 MHz, about 12.59 dBi at 546 MHz, about 13.78 dBi at 622 MHz, and about 14.36 dBi at 698 MHz.

Figure 39:
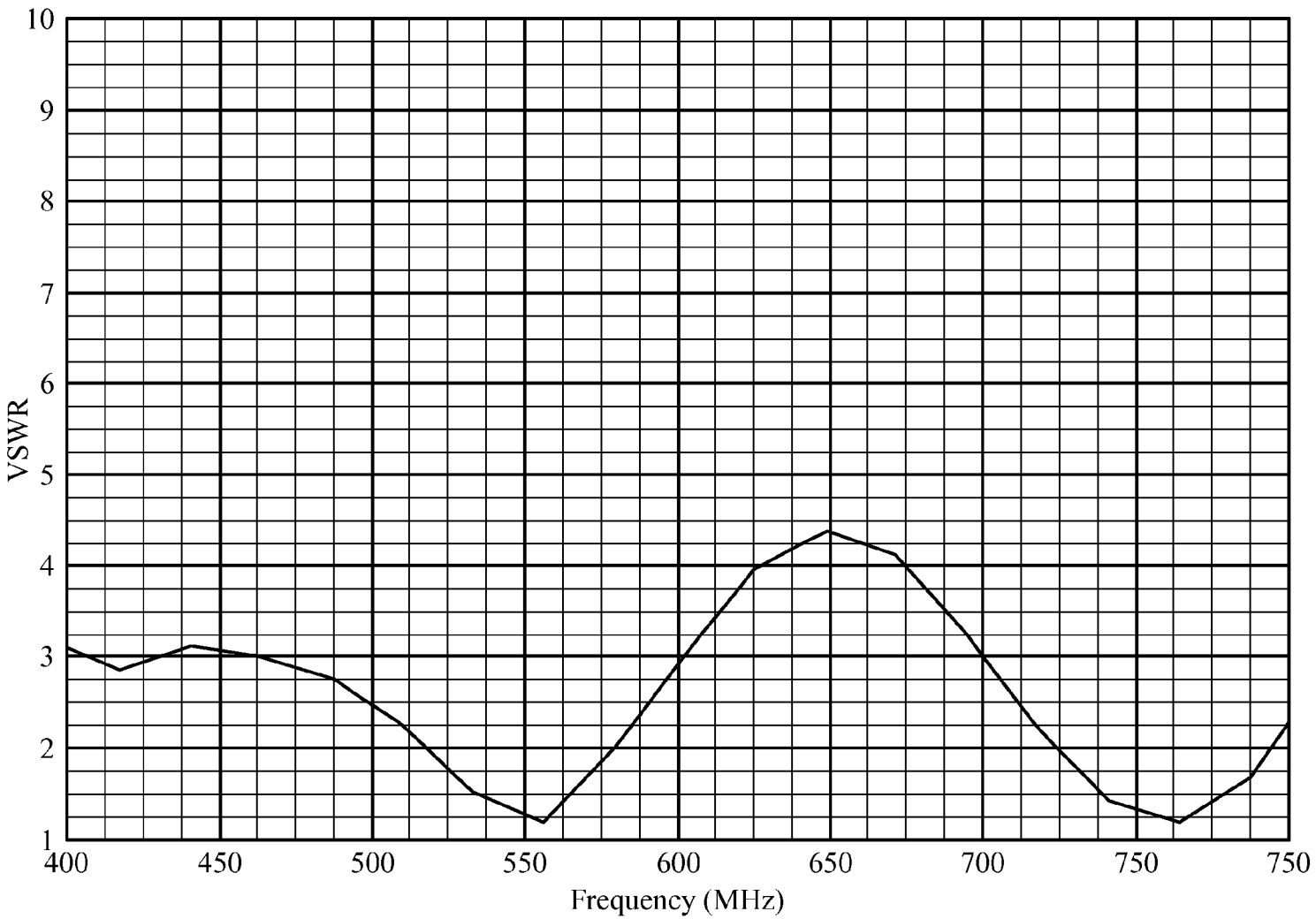
FIG. 39 is an exemplary line graph showing computer-simulated Voltage Standing Wave Ratio (VSWR) versus frequency (MHz) for the antenna assembly shown in FIG. 27.
Figure 40:
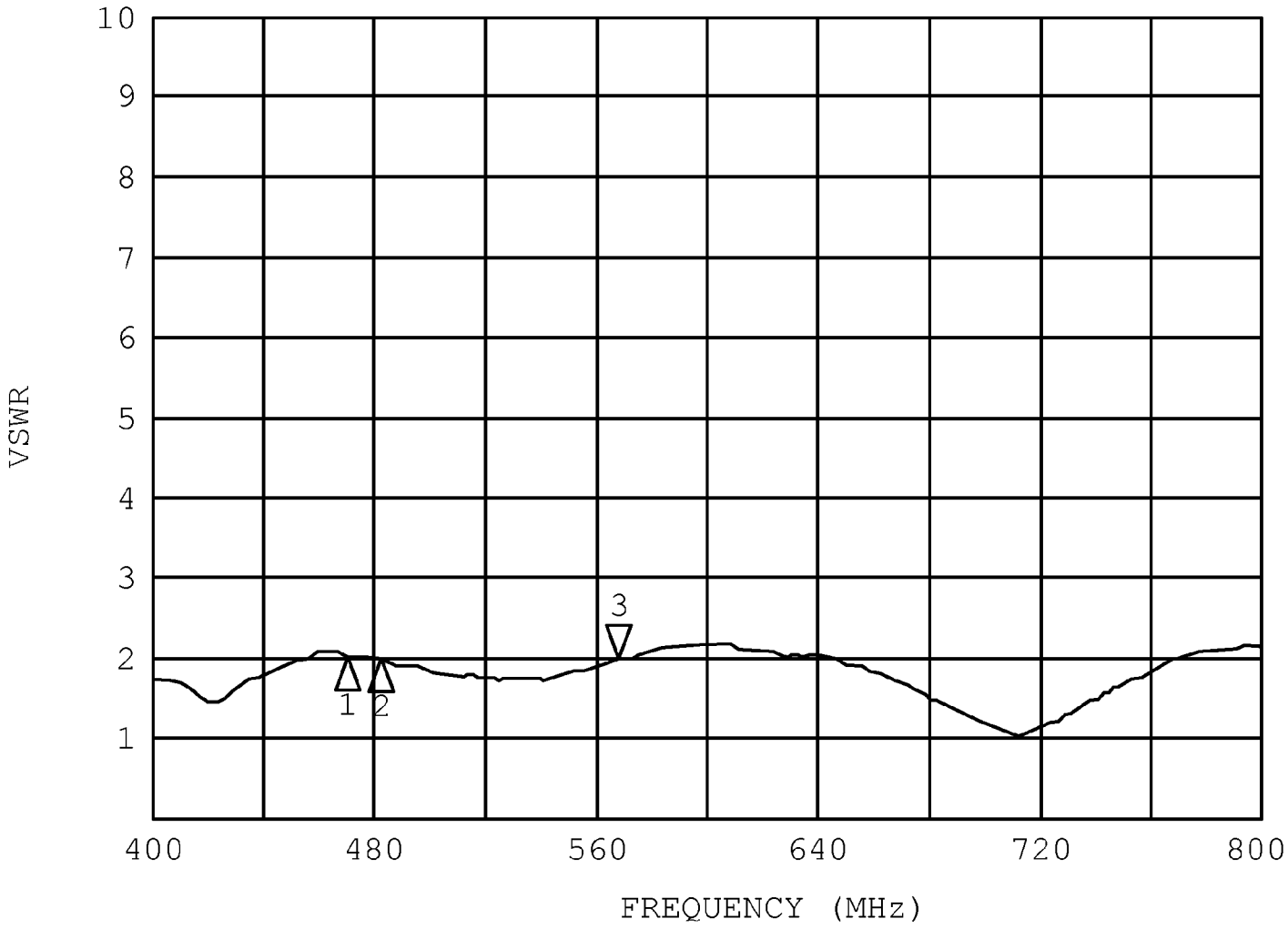
FIG. 40 is an exemplary line graph showing measured VSWR versus frequency (MHz) as measured outdoors for the antenna assembly shown in FIG. 27 on a ten foot mast above a concrete pad.

FIG. 39 is an exemplary line graph showing computer-simulated voltage standing wave ratio (VSWR) versus frequency (MHz) for the antenna assembly 200. FIG. 40 is an exemplary line graph showing measured VSWR versus frequency (MHz) as measured outdoors for the antenna assembly 200 on a ten foot mast above a concrete pad. Generally, VSWR is the ratio of the maximum to minimum voltage on the antenna feeding line, where a perfectly impedance matched antenna has a VSWR of 1:1. With further reference to FIG. 40, the VSWR of the antenna assembly 200 is about 2.0316 at 470 MHz (marker 1), about 1.9856 at 482 MHz (marker 2), and about 2.0035 at 568 MHz (marker 3). The performance data as measured outdoors revealed a maximum VSWR of no more than about 3.0 between 470 MHz and 698 MHz.

With further regard for the performance characteristics of the antenna assembly 200, this exemplary embodiment of the antenna assembly 200 has a peak gain of 14.5 dBi, and a front to back ratio greater than 18 dBi. Also, this exemplary antenna assembly 200 had a strong performance across the digital television (DTV) spectrum as shown by the line graphs in FIGS. 37 through 40 and succeeded in difficult reception areas (e.g., works great in attics, etc.). This exemplary antenna assembly 200 also includes an all-weather balun, flexible aiming characteristic, 60 degree beam-width, and is capable of being used indoors, outdoors, or in an attic. The antenna assembly 200 may also have a range of greater than sixty-five miles and/or may have the following example dimensions including a width of 23 inches, a height of 37.5 inches, and a depth of 7 inches.

Any of the various embodiments may include one or more components (e.g., bow tie antenna, balun, reflector, etc.) similar to components of antenna assembly 100 or 200. In addition, any of the various embodiments may be operable and configured similar to the antenna assembly 100 or 200 in at least some embodiments thereof. Accordingly, embodiments of the present disclosure include antenna assemblies that may be scalable to any number of (one or more) bow tie antennas depending, for example, on the particular end-use, signals to be received or transmitted by the antenna assembly, and/or desired operating range for the antenna assembly.

In another exemplary embodiment, an antenna assembly may include a pair of four bow tie element arrays (e.g., array 200, etc.). The two arrays may be coupled to each other such that two arrays are rotatable. For example, each array may be coupled to an end portion of a cross bar mount via a bracket and mechanical fasteners (e.g., washers, nuts, and bolts, etc.). This mounting arrangement allows the two arrays (e.g., bow tie antennas and reflectors, etc.) to be rotated or turned in a 180 degree loop, e.g., to target broadcast towers in any direction or separate directions, etc. By way of example, this exemplary embodiment may have a range of greater than 70 miles, have very flexible aiming characteristics, and weatherproof construction. By way of further example, the antenna assembly may have high gain across entire UHF band (e.g., UHF channels 14-51, etc.), an impedance of 75 ohm, a max gain of 17.4 dBi, and/or may have a width of 50 inches, a height of 37.5 inches, a depth of 6 inches, and a product weight of 12 pounds.

Other embodiments relate to methods of making and/or using antenna assemblies. Various embodiments relate to methods of receiving digital television signals, such as high definition television signals within a frequency range of about 174 megahertz to about 216 megahertz and/or a frequency range of about 470 megahertz to about 690 megahertz. In one example embodiment, a method generally includes connecting at least one communication link (e.g., coaxial cable 126, etc.) from an antenna assembly (e.g., 100, 200, etc.) to a television for communicating signals to the television that are received by the antenna assembly. In this method embodiment, the antenna assembly may include at least one pair of spaced apart bow tie antennas (e.g., 104, 114, 204, 214, 274, 284, etc.) and at least one reflector element (e.g., 150, 250, 252, etc.). In another example, a method may include mounting an antenna assembly including at least one pair of spaced apart bow tie antennas and at least one reflector element, where the antenna assembly is to be supported on a horizontal or vertical surface.

The antenna assembly may be operable for receiving high definition television signals having a frequency range of about 470 megahertz and about 690 megahertz. The antenna elements (along with reflector size and spacing) may be tuned to at least one electrical resonant frequency for operating within a bandwidth ranging from about 470 megahertz to about 690 megahertz. The reflector element may be spaced apart from the antenna elements for reflecting electromagnetic waves generally towards the antenna elements and generally affecting impedance bandwidth and directionality.

Embodiments of an antenna assembly disclosed herein may be configured to provide one or more of the following advantages. For example, exemplary embodiments disclosed herein may be specifically configured for reception (e.g., tuned and/or targeted, etc.) for use with the year 2009 digital television (DTV) spectrum of frequencies (e.g., HDTV signals within a first frequency range of about 174 megahertz and about 216 megahertz and signals within a second frequency range of about 470 megahertz and about 690 megahertz, etc.) and be relatively highly efficient and have relatively good gain and consistency across the 2009 DTV spectrum. With such relatively good efficiency and gain, high quality television reception may be achieved without requiring or needing amplification of the signals received by some exemplary antenna embodiments. Additionally, or alternatively, exemplary embodiments may also be configured for receiving VHF signals (e.g., VHF frequency range from 174 MHz to 216 MHz (Channels 7-13), etc.) and/or UHF signals (e.g., UHF 470 MHz to 806 MHz (Channels 14-69), etc.).

Exemplary embodiments of bow tie antennas and antenna assemblies have been disclosed herein as being used for reception of digital television signals, such as HDTV signals. Alternative embodiments, however, may include antenna elements tuned for receiving non-television signals and/or signals having frequencies not associated with HDTV. Other embodiments may be used for receiving FM signals, UHF signals, VHF signals, etc. Thus, embodiments of the present disclosure should not be limited to receiving only television signals having a frequency or within a frequency range associated with digital television or HDTV. Antenna assemblies disclosed herein may alternatively be used in conjunction with any of a wide range of electronic devices, such as radios, computers, etc. Therefore, the scope of the present disclosure should not be limited to use with only televisions and signals associated with television.

Numerical dimensions and specific materials disclosed herein are provided for illustrative purposes only. The particular dimensions and specific materials disclosed herein are not intended to limit the scope of the present disclosure, as other embodiments may be sized differently, shaped differently, and/or be formed from different materials and/or processes depending, for example, on the particular application and intended end use.

Certain terminology is used herein for purposes of reference only, and thus is not intended to be limiting. For example, terms such as "upper", "lower", "above", "below", "upward", "downward", "forward", and "rearward" refer to directions in the drawings to which reference is made. Terms such as "front", "back", "rear", "bottom" and "side", describe the orientation of portions of the component within a consistent, but arbitrary, frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

Disclosure of values and ranges of values for specific parameters (such as frequency ranges, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. An antenna assembly operable for receiving high definition television signals, the antenna assembly comprising:

an antenna support;

at least one pair of bow tie antennas coupled to the antenna support and spaced part from each other;

at least one reflector coupled to the antenna support and disposed relative to the at least one pair of bow tie antennas for reflecting electromagnetic waves generally towards the at least one pair of bow tie antennas;

one or more pairs of electrical conductors extending between a balun and the at least one pair of bow tie antennas, the one or more pairs of electrical conductors electrically connecting the balun with the at least one pair of bow tie antennas, the one or more pairs of electrical conductors are operable as a corporate feed and/or form a parallel wire transmission structure; and dielectric mounting members coupling the at least one pair of bow tie antennas to the antenna support, wherein the dielectric mounting members include one or more recessed portions or slots configured for providing a stop for angled electrical conductor portions of the electrical conductors and for providing a stop for straight electrical conductor portions of the electrical conductors.

2. The antenna assembly of claim 1, wherein:

the at least one pair of bow tie antennas comprises a first pair of bow tie antennas spaced apart from each other and a second pair of bow tie antennas spaced apart from each other;

the at least one reflector comprises a first reflector behind the first pair of bow tie antennas for reflecting electromagnetic waves generally towards the first pair of bow tie antennas, and a second reflector behind the second pair of bow tie antennas for reflecting electromagnetic waves generally towards the second pair of bow tie antennas;

the one or more pairs of electrical conductors are operable as a corporate feed and include a first pair of electrical conductors that extends generally towards the first reflector and then back generally towards the balun, and a second pair of electrical conductors that extends generally towards the second reflector and then back generally towards the balun;

a first pair of straight electrical conductors electrically connect the first pair of bow tie antennas; and a second pair of straight electrical conductors electrically connecting the second pair of bow tie antennas.

3. The antenna assembly of claim 2, wherein:

the balun is electrically equidistant from the first and second pairs of bow tie antennas such that the bow tie antennas are in phase;

the first pair of electrical conductors electrically connects the balun and the first pair of bow tie antennas whereby the first pair of electrical conductors is bent over part of their length generally towards the first reflector and then back generally towards the balun; and the second pair of electrical conductors electrically connects the balun and the second pair of bow tie antennas whereby the second pair of electrical conductors include a portion that is bent generally towards the second reflector and then back generally towards the balun.

4. The antenna assembly of claim 2, further comprising dielectric mounting members coupling the at least one pair of bow tie antennas to the antenna support, wherein the dielectric mounting members are configured for providing a stop for angled portions of the one or more pairs of electrical conductors and for providing a stop for straight portions of the first and second pairs of straight electrical conductors.

5. The antenna assembly of claim 1, wherein each said bow tie antenna including a pair of antenna elements, each said antenna element including spaced apart end portions defining an open portion whereby dielectric is positionable between the spaced apart end portions.

6. The antenna assembly of claim 5, wherein each said antenna element has an open shape which is closed by the dielectric extending across a gap separating the spaced apart end portions, such that the pair of antenna elements and the dielectric cooperatively define a closed bow tie shape for the bow tie antenna.

7. The antenna assembly of claim 6, wherein each said antenna element is not closed electrically by the dielectric which is inoperable for galvanically connecting the spaced apart end portions of the antenna elements.

8. The antenna assembly of claim 6, wherein the dielectric comprises:

a plurality of pieces of dielectric tubing, each said piece of dielectric tubing having openings in which are positioned spaced apart end portions of a corresponding one of the antenna elements; or a plurality of dielectric connectors each of which is physically connected to spaced apart end portions of a corresponding one of the antenna elements.

9. An antenna assembly operable for receiving high definition television signals, the antenna assembly comprising:

an antenna support;

at least one pair of bow tie antennas coupled to the antenna support and spaced part from each other;

at least one reflector coupled to the antenna support and disposed relative to the at least one pair of bow tie antennas for reflecting electromagnetic waves generally towards the at least one pair of bow tie antennas; and one or more pairs of electrical conductors extending between a balun and the at least one pair of bow tie antennas, the one or more pairs of electrical conductors electrically connecting the balun with the at least one pair of bow tie antennas, the one or more pairs of electrical conductors are operable as a corporate feed and/or form a parallel wire transmission structure;

wherein:

axial spacing of the one or more pairs of electrical conductors forms a parallel wire transmission structure; and the one or more pairs of electrical conductors include portions that are bent inwards generally towards the at least one reflector to create an impedance transformer and an improved impedance match at a feed point of the balun.

10. The antenna assembly of claim 9, wherein the one or more pairs of electrical conductors comprise bent or shaped wire.

11. The antenna assembly of claim 9, further comprising dielectric mounting members coupling the at least one pair of bow tie antennas to the antenna support, wherein the dielectric mounting members include one or more recessed portions or slots configured for providing a stop for angled electrical conductor portions of the electrical conductors and for providing a stop for straight electrical conductor portions of the electrical conductors.

12. An antenna assembly operable for receiving high definition television signals, the antenna assembly comprising:

an antenna support;

at least one pair of bow tie antennas coupled to the antenna support and spaced part from each other;

at least one reflector coupled to the antenna support and disposed relative to the at least one pair of bow tie antennas for reflecting electromagnetic waves generally towards the at least one pair of bow tie antennas; and one or more pairs of electrical conductors extending between a balun and the at least one pair of bow tie antennas, the one or more pairs of electrical conductors electrically connecting the balun with the at least one pair of bow tie antennas, the one or more pairs of electrical conductors are operable as a corporate feed and/or form a parallel wire transmission structure;

wherein:

the balun is electrically equidistant from each said bow tie antenna such that the bow tie antennas are in phase;

axial spacing of the one or more pairs of electrical conductors forms a parallel wire transmission structure; and the one or more pairs of electrical conductors include portions that extend inwards generally towards the at least one reflector to create an impedance transformer and an improved impedance match at a feed point of the balun.

13. The antenna assembly of claim 12, further comprising dielectric mounting members coupling the bow tie antennas to the antenna support, wherein the dielectric mounting members are configured for providing a stop for angled portions of the one or more pairs of electrical conductors.

14. An antenna assembly operable for receiving high definition television signals, the antenna assembly comprising:

at least one pair of bow tie antennas spaced apart from each other, each said bow tie antenna including a pair of antenna elements; and one or more pairs of electrical conductors extending between a balun and the at least one pair of bow tie antennas, the one or more pairs of electrical conductors electrically connecting the balun with the at least one pair of bow tie antennas;

whereby axial spacing of the one or more pairs of electrical conductors forms a parallel wire transmission structure, and whereby the one or more pairs of electrical conductors include portions that extend inwards generally away from the balun to create an impedance transformer and an improved impedance match at a feed point of the balun.

15. The antenna assembly of claim 14, wherein:

a reflector is disposed relative to the at least one pair of bow tie antennas for reflecting electromagnetic waves generally towards the at least one pair of bow tie antennas;

the one or more pairs of electrical conductors comprise wire that is bent or shaped so as to extend inwards over part of its length generally towards the at least one reflector and then back generally towards the balun;

the balun is electrically equidistant from each said bow tie antenna such that the bow tie antennas are in phase; and the antenna assembly further comprises dielectric mounting members coupling the bow tie antennas to an antenna support, wherein the dielectric mounting members are configured for providing a stop for angled portions of the one or more pairs of electrical conductors.

16. The antenna assembly of claim 14, wherein each said bow tie antenna including a pair of antenna elements, each said antenna element including spaced apart end portions defining an open portion whereby dielectric is positionable between the spaced apart end portions.

17. The antenna assembly of claim 14:

wherein the at least one pair of bow tie antennas comprises: a first pair of bow tie antennas spaced apart from each other; and a second pair of bow tie antennas spaced apart from each other;

wherein the antenna assembly further comprises a first reflector behind the first pair of bow tie antennas for reflecting electromagnetic waves generally towards the first pair of bow tie antennas; and a second reflector behind the second pair of bow tie antennas for reflecting electromagnetic waves generally towards the second pair of bow tie antennas; and wherein the one or more pairs of electrical conductors are operable as a corporate feed for the bow tie antennas.

18. The antenna assembly of claim 17, wherein the one or more pairs of electrical conductors include:

a first pair of electrical conductors including a portion that extends inward generally towards the first reflector and then back generally towards the first pair of bow tie antennas;

a second pair of electrical conductors including a portion that extends inward generally towards the second reflector and then back generally towards the second pair of bow tie antennas;

a third pair of electrical conductors electrically connect the first pair of bow tie antennas to each other; and a fourth pair of electrical conductors electrically connecting the second pair of bow tie antennas to each other.

19. The antenna assembly of claim 18, wherein:

the first pair of electrical conductors electrically connect the first pair of bow tie antennas to the balun;

the second pair of electrical conductors electrically connect the second pair of bow tie antennas to the balun; and the balun is electrically equidistant from the first and second pairs of bow tie antennas such that the bow tie antennas are in phase.

20. The antenna assembly of claim 18, wherein:

the first and second pairs of electrical conductors comprise bent or shaped wire;

the third and fourth pairs of electrical conductors comprise generally straight wire;

the antenna assembly further comprises dielectric mounting members coupling the bow tie antennas to an antenna support, wherein the dielectric mounting members are configured for providing a stop for angled portions of the first and second pairs of electrical conductors and for providing a stop for straight portions of the third and fourth pairs of electrical conductors; and each said bow tie antenna including a pair of antenna elements, each said antenna element including spaced apart end portions defining an open portion whereby dielectric is positionable between the spaced apart end portions.

* * * * *